US005207390A

United States Patent [19]

Ikeda et al.

[11] Patent Number: 5,207,390

[45] Date of Patent: May 4, 1993

[54] OPERATION CONTROL SYSTEM FOR A SHREDDER

[75] Inventors: Yoshitaka Ikeda; Noriyuki Akasaka, both of Nagoya; Hisataka Yonezawa; Wataru Matsubara, both of Yokohama; Etsuko Kinoshita, Kobe; Hidetaka Ono, Yokohama, all of Japan

[73] Assignee: Mitsubishi Jukogyo Kabushiki Kaisha, Tokyo, Japan

[21] Appl. No.: 746,408

[22] Filed: Aug. 16, 1991

[30] Foreign Application Priority Data

| | | | |
|---|---|---|---|
| Aug. 30, 1990 | [JP] | Japan | 2-228667 |
| Feb. 18, 1991 | [JP] | Japan | 3-023042 |
| Jun. 12, 1991 | [JP] | Japan | 3-140273 |

[51] Int. Cl.[5] ..... B02C 25/00

[52] U.S. Cl. ..... 241/34; 241/35

[58] Field of Search ..... 241/34, 35; 198/502.2

[56] References Cited

U.S. PATENT DOCUMENTS

| | | | |
|---|---|---|---|
| 3,335,967 | 8/1967 | Williams | 241/35 |
| 4,344,520 | 8/1982 | Czoch et al. | 198/347 |
| 4,515,318 | 5/1985 | Savonjousi | 241/28 |
| 4,804,148 | 2/1989 | Etheridge | 241/35 |

FOREIGN PATENT DOCUMENTS

| | | | |
|---|---|---|---|
| 0656661 | 4/1979 | U.S.S.R. | 241/34 |
| 2211004 | 6/1989 | United Kingdom | 241/35 |

*Primary Examiner*—Carl E. Hall
*Assistant Examiner*—John M. Husar
*Attorney, Agent, or Firm*—Wenderoth, Lind & Ponack

[57] ABSTRACT

A control system for a refuse shredder composed of a refuse feeding section and a refuse shredding section detects a stagnating state of refuse to adjust the feed rate, detects idling of the feeding section and restores it to a proper state, detects a tendency of tripping of a shredder drive motor and prevents such tripping, and generally automates an operation of the shredder. The system includes an image pickup device for picking up an image of a refuse inlet of the shredder, an image processor for binary-coding an image signal generated by the image pickup device to obtain a characteristic quantity of the refuse, and control calculator for calculating and outputting a control signal for controlling the feeding section and the shredding section on the basis of the characteristic quantity of the refuse obtained by the image processor. Preferably, the system further includes a current detector for detecting a drive current value of a drive motor for the feeding section and the shredding section, and the control calculator calculates and outputs a control signal for controlling the feeding section and the shredding section on the basis of the above-mentioned characteristic quantity of the refuse as well as the detected drive current value of the drive motor.

4 Claims, 18 Drawing Sheets

OPERATION CONTROL SYSTEM FOR A SHREDDER

BACKGROUND OF THE INVENTION

1. Field of the Invention

The present invention relates to an operation control system for a shredder, which is especially applicable to a rotary type shredder or the like.

2. Description of the Prior Art

A basic structure of a rotary type shredder that is generally used as one of bulky refuse processing apparatuses, is shown in FIG. 16.

In this figure, reference numeral 1 designates a feed conveyor for feeding refuse 20, numeral 2 designates a compression feeder which feeds the refuse 20 to a shredding section 9 while crushing it, and this compression feeder 2 is adapted to be moved vertically by means of an elevator cylinder 5. It is to be noted that although not shown, the compression feeder 2 is rotationally driven by a compression feeder drive motor. In addition, reference numeral 4 designates a push-in device, which is provided for the purpose of pushing the refuse 20 when the refuse 20 cannot be bitten by the compression feeder 2. Reference numeral 6 designates a bar-shaped cutter which is generally called "cutter bar", and reference numeral 7 designates hammers rotating about a point 0, which hammers are rotationally driven by a shredder drive motor (not shown).

Refuse 20 collected by a refuse collecting car or the like is unloaded on the feed conveyor 1, and then it is conveyed to a slide-shaped refuse throw-in section (inlet of a shredding section) 3. The refuse 20 at the refuse throw-in section 3 is fed to a shredding section (shredder main body) 9 while being crushed by the compression feeder 2, and it is shredded by the hammers 7 and the cutter bar 6. A stagnating condition of the refuse 20 at the refuse throw-in section 3 is monitored by means of an ITV camera 11, and an operator controls ON/OFF of the feed conveyor 1, ON/OFF of the compression feeder 2, ON/OFF of the push-in device 4 and UP/DOWN of the elevator cylinder 5 while always watching a screen of a monitor television set.

In a bulky refuse processing apparatus in the prior art, since provision was made such that an operator carried out control for the respective locations while always watching a screen of a monitor television set as described above, a burden upon an operator was large, and in order to mitigate this burden, a demand for automating an operation of a shredder was intense. However, automatically performing acknowledgement of a stagnating condition of refuse, was difficult in an apparatus working under a bad environmental condition such as dust, humidity and impacts as is the case with the above-described shredder, and automation of the operation was prevented due to the aforementioned point acting as a neck.

In addition, the above-described compression feeder 2 in the prior art was operated at a constant peripheral velocity. Consequently, various kinds of refuse 20 were fed to the shredding section 9 at the same speed without differentiating wood not burdening a shredder drive motor from refrigerators, iron scraps and the like heavily burdening a shredder drive motor. Accordingly, there was the problem that in some cases refuse 20 to be shredded was not fed to the shredding section 9 despite of the shredder drive motor having large surplus capacity, but in other cases large-sized refuse 20 acting as a heaving shredding load was fed to the shredding section 9 despite of the shredder drive motor having almost no surplus capacity, and caused tripping of the same drive motor.

Also, a depressing pressure of the above-described compression feeder 2 against the refuse throw-in section 3 must be enlarged as the shredding load is increased because a pulling force into the main body of the shredding section 9 by the hammer 7 becomes strong. However, since the above-described depressing pressure was varied by an operator manipulating an ON/OFF button of a hydraulic valve for the elevator cylinder 5, it was impossible to perform fine control, and therefore, in some case the pulling force into the main body of the shredding section 9 by the hammer 7 became strong and caused the shredder drive motor to trip.

Furthermore, if the depressing pressure against the refuse throw-in section 3 by the above-mentioned compression feeder 2 is excessively enlarged, it may be possible to cause a compression feeder drive motor to trip or stop.

SUMMARY OF THE INVENTION

The present invention has been worked out under the above-mentioned circumstance of the art, and it is one object of the present invention to provide an operation control system for a shredder which is possible to perfectly automate the operation.

According to novel features of the present invention, there are provided operation control systems for a shredder as enumerated in the following:

(1) An operation control system for a shredder composed of a feeding section and a shredding section of refuse, comprising:

image pickup means such as, for example, a television camera for picking up an image of a refuse inlet of the shredding section;

image processing means for image processing such as binary-coding an image signal generated by the image pickup means to obtain a characteristic quantity of the refuse; and control calculator means for calculating and outputting a control signal for controlling a feed conveyor and a feeder provided in the aforementioned feeding section and the above-mentioned shredding section on the basis of the above-described characteristic quantity of the refuse obtained by the aforementioned image processing means.

(2) An operation control system for a shredder as described in numbered paragraph (1) above, wherein the above-mentioned image processing means seeks for an area of the refuse or a circumscribing rectangle of the refuse in the obtained binary-coded image, and the above-described control calculator means calculates and outputs a control signal for instructing feed of refuse if the area of the refuse or the length of the edge in the throw-in direction of the shredder of the circumscribing rectangle of refuse is equal to or smaller than a first threshold value "$L_1$", while it calculates and outputs a control signal instructing stoppage of feed of refuse if the same area or length is equal to or larger than a second threshold value "$L_2$" ($L_1 < L_2$).

(3) An operation control system for a shredder composed of a feeding section consisting of a compression feeder and a feed conveyor for feeding refuse, and a shredding section for shredding the refuse fed from the above-mentioned feeding section, comprising:

image pickup means such as, for example, a television camera for picking up an image of a refuse inlet of the shredding section;

image processing means for image-processing such as binary-coding an image signal generated by the image pickup means to obtain a characteristic quantity of the refuse;

current detector means for detecting a drive current value of a drive motor of the aforementioned compression feeder; and control calculator means for calculating and outputting a control signal for controlling a feed rate of refuse at the above-mentioned feeding section on the basis of the characteristic quantity of the refuse obtained by the above-mentioned image processing means and the drive current value of the drive motor detected by the aforementioned current detector means.

(4) An operation control system for a shredder as described in numbered paragraph (3) above, wherein the aforementioned image processing means seeks for an area of the refuse or a circumscribing rectangle of the refuse in the obtained binary-coded image, and the above-mentioned control calculator means calculates and outputs a control signal for instructing a biting operation for the refuse, in which the above-mentioned compression feeder is temporarily moved as a result of judgement that the compression feeder is idling, if the above-described drive current value of the drive motor detected by the aforementioned current detector means is equal to or smaller than a predetermined threshold value for a predetermined period of time or more, in the case where the area of the refuse or the length of the edge in the throw-in direction of the shredder of the circumscribing rectangle of the refuse sought for by the image processing means is not "0 (zero)".

(5) An operation control system for a shredder composed of a feeding section and a shredding section of refuse, comprising:

image pickup means such as, for example, a television camera for picking up an image of a refuse inlet of the shredding section;

image processing means for image-processing such as binary-coding an image signal generated by the image pickup means to obtain a characteristic quantity of the refuse;

current detector means for detecting a drive current value of a drive motor for driving the aforementioned shredder; and control calculator means for calculating and outputting a control signal for controlling a feed rate of refuse at the above-mentioned feeding section on the basis of the characteristic quantity of the refuse obtained by the above-described image processing means and the drive current value of the drive motor detected by the aforementioned current detector means.

(6) An operation control system for a shredder as described in numbered paragraph (5) above, wherein the aforementioned image processing means seeks for an area of the refuse or a circumscribing rectangle of the refuse in the obtained binary-coded image, and the above-mentioned control calculator means calculates and outputs a control signal, which suppresses a feed rate of the refuse at the above-mentioned feeding section so as to prevent over-loading of the drive motor of the aforementioned shredder when the drive current value of the drive motor detected by the aforementioned current detector means has become equal to or larger than a predetermined threshold value, but which releases the suppression to the feed rate of the refuse at the above-mentioned feeding section when the area of the refuse or the length of the edge in the throw-in direction of the shredder of the circumscribing rectangle of the refuse sought for by the above-mentioned image processing means has become equal to or smaller than a predetermined threshold value.

(7) An operation control system for a shredder composed of a feeding section consisting of a compression feeder and a feed conveyor for feeding refuse, and a shredding section for shredding the refuse fed from the above-mentioned feeding section, comprising:

image pickup means such as, for example, a television camera for picking up an image of a refuse inlet of the shredding section;

image processing means for image-processing such as binary-coding an image signal generated by the image pickup means to obtain a characteristic quantity of the refuse;

first current detector means for detecting a drive current value of a drive motor for the above-mentioned compression feeder;

second current detector means for detecting a drive current value of a drive motor for the above-mentioned shredder; and control calculator means for calculating and outputting a control signal for controlling a feed rate of refuse at the above-mentioned feeding section on the basis of the above-described characteristic quantity of the refuse obtained by the aforementioned image processing means and the drive current values detected respectively by the above-mentioned first current detector means and the above-mentioned second current detector means.

(8) An operation control system for a shredder composed of a feeding section and a shredding section of refuse, comprising:

current detector means for detecting a drive current value of a drive motor for driving the above-mentioned shredding section; and desired value calculator means for calculating a desired value of a peripheral velocity of a compression feeder in the above-mentioned feeding section on the basis of the drive current value detected by the aforementioned current detector means, and outputting it to a control section of the drive motor of the aforementioned compression feeder.

(9) An operation control system for a shredder as described in numbered paragraph (8) above, wherein the above-described desired value calculator means calculates the desired value of the peripheral velocity of the compression feeder as a decreasing function with respect to the drive current value detected by the aforementioned current detector means.

(10) An operation control system for a shredder as described in numbered paragraph (8) above, wherein the above-described desired value calculator means calculates a difference between a desired current value of the drive motor for driving the above-mentioned shredding section and the drive current value of the same drive motor detected by the aforementioned current detector means, and calculates the desired value of the peripheral velocity of the aforementioned compression feeder on the basis of the difference.

(11) An operation control system for a shredder composed of a feeding section and a shredding section of refuse of refuse, comprising:

current detector means for detecting a drive current value of a drive motor for driving the above-mentioned shredding section;

opening detector means for detecting an opening of the compression feeder in the above-mentioned feeding section from a flow of a throw-in section; and desired value calculator means for calculating a desired value of a depressing pressure of an elevator cylinder for regulating the opening of the compression feeder on the basis of the driving current value detected by the above-mentioned current detector means and the compression feeder opening detected by the aforementioned opening detector means, and outputting it to a control section of the above-described elevator cylinder.

(12) An operation control system for a shredder composed of a feeding section and a shredding section of refuse, comprising:

current detector means for detecting a drive current value of a drive motor for driving the aforementioned shredding section;

opening detector means for detecting an opening of the compression feeder in the above-mentioned feeding section from a floor of a throw-in section;

load detector means for detecting a driving load of a drive motor for the above-mentioned compression feeder; and desired value calculator means for calculating a possible desired value of a depressing pressure of an elevator cylinder for regulating the opening of the compression feeder on the basis of the drive current value detected by the above-mentioned current detector means and the compression feeder opening detected by the above-mentioned opening detector means, and calculating an eventual desired value of the depressing pressure of the above-mentioned elevator cylinder on the basis of the aforementioned possible desired value and the driving load of the drive motor for the compression feeder detected by the aforementioned load detector means.

(13) An operation control system for a shredder composed of a feeding section for feeding refuse and a shredding section for shredding the refuse fed from the aforementioned feeding section, comprising:

image pickup means for picking up an image of a refuse inlet of the above-mentioned shredding section;

image processing means for image-processing an image signal generated by the above-mentioned image pickup means to obtain a characteristic quantity consisting of at least one of an area and a circumscribing rectangle of the above-described refuse in a binary-coded image;

current detector means for detecting a drive current value of a drive motor for driving the aforementioned shredder; and control calculator means for calculating and outputting a control signal for instructing a biting operation for the refuse by controlling a push-in device for carrying out push-in feed of the refuse at the feeding section as well as a peripheral velocity and a position in the vertical direction of the above-mentioned compression feeder, as a result of judgement that the compression feeder in the above-mentioned feeding section is idling, if the drive current value of the drive motor detected by the aforementioned current detector means is equal to or smaller than a threshold value $i_{s0}$ for a predetermined period of time or more, in the case where the area or the length of the edge in the throw-in direction of the shredder of the circumscribing rectangle of the refuse is not zero according to the characteristic quantity of the above-mentioned refuse detected by the aforementioned image processing means.

(14) An operation control system for a shredder as described in numbered paragraph (13) above, wherein the above-described control calculator means calculates and outputs a control signal for instructing a biting operation of the aforementioned refuse by controlling a push-in device for carrying out push-in feed of the refuse at the feeding section as well as a peripheral speed and a position in the vertical direction of the aforementioned compression feeder, as a result of judgement that the compression feeder in the above-mentioned feeding section is idling, if the drive current value of the drive motor detected by the aforementioned current detector means is equal to or smaller than a first threshold value $i_{s0}$ for a predetermined period of time or more, in the case where the area or the length of the edge in the throw-in direction of the shredder of the circumscribing rectangle of the refuse obtained by the aforementioned image processing means is not zero, while it calculates and outputs a control signal for suppressing a feed rate of the refuse at the above-mentioned feeding section to prevent over-loading of the drive motor for the aforementioned shredder regardless of the characteristic quantity obtained by the above-mentioned image processing means and releasing the suppressed condition when the characteristic quantity obtained by the aforementioned image processing means again has become equal to or smaller than a predetermined threshold value, if the drive current value of the drive motor detected by the aforementioned current detector means is equal to or larger than a second threshold value $i_{s1}$ ($i_{s0}<i_{s1}$) determined period time or more.

(15) An operation control system for a shredder as described in numbered paragraph (14) above, wherein the aforementioned control calculator means calculates and outputs a control signal for instructing feed of refuse by the above-mentioned feeding section if the area of the refuse or the length of the edge in the throw-in direction of the shredder of the circumscribing rectangle of the refuse obtained by the aforementioned image processing means is equal to or smaller than a first threshold value $L_1$, while it calculates and outputs a control signal for instructing stoppage of feed or refuse by the aforementioned feeding section if said area or said length is equal to or larger than a second threshold value ($L_1<L_2$).

According to the present invention having the novel features as enumerated in numbered paragraphs (1) through (15) above, the following advantages are obtained:

In the operation control system for a shredder as enumerated in numbered paragraphs (1) to (7) above, owing to the above-described structural features, it becomes possible to detect a stagnated state of refuse, to feed refuse at a proper feed rate that is neither excessive nor short, to detect and recover occurrence of idling slip of a feeder, and to detect and prevent a tendency of tripping of a shredder drive motor, and a burden upon an operator can be greatly mitigated by automating an operation of a shredder.

In the operation control system for a shredder as enumerated in numbered paragraphs (8) to (12) above, owing to the above-described structural features, a peripheral velocity of a compression feeder for feeding refuse can be controlled by feedback on the basis of a drive current value of a shredder drive motor and a feed rate of the refuse is controlled so that a shredder drive motor can be operated always at a current in the neighborhood of a rating current, and on the other hand, a depressing pressure of an elevator cylinder for regulating an opening of a compression feeder is controlled by feedback on the basis of a drive load of a drive motor for the compression feeder, and thereby troubles which may arise in the drive motor for the compression feeder can be avoided.

In the operation control system for a shredder as enumerated in numbered paragraphs (13) to (15), owing to the above-described structural features, it becomes possible to detect a stagnated state of refuse, to feed refuse at a proper feed rate that is neither excessive nor short, to detect and recover occurrence of idling slip of a feeder, and to detect and prevent a tendency of tripping of a shredder drive motor, and a burden upon an operator can be greatly mitigated by automating an operation of a shredder.

The above-mentioned and other objects, features and advantages of the present invention will become more apparent by reference to the following description of a number of preferred embodiments of the invention taken in conjunction with the accompanying drawings.

DESCRIPTION OF THE PREFERRED EMBODIMENTS

Now a first preferred embodiment of the present invention will be described with reference to FIGS. 1 to 3.

Figure 1:
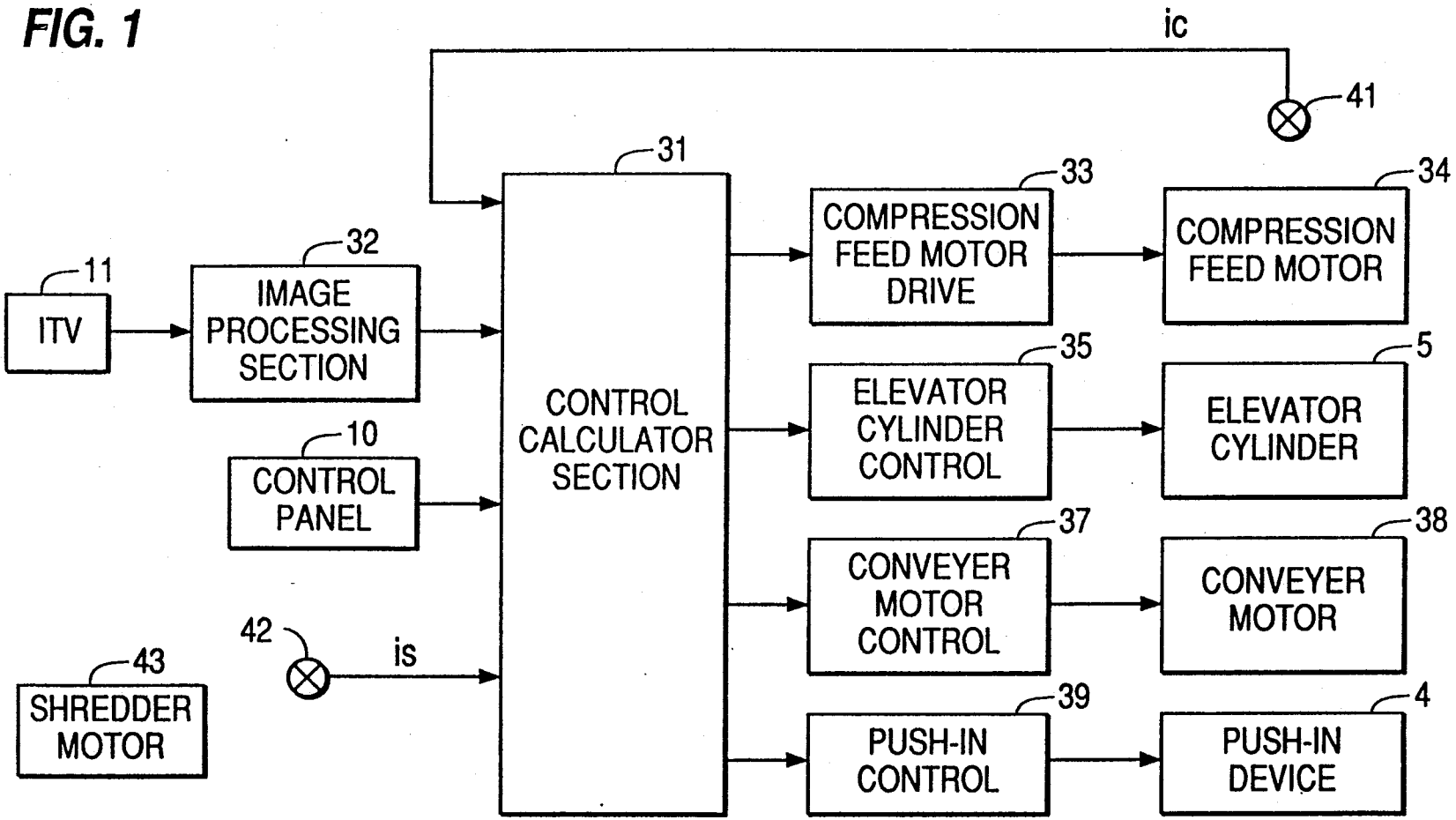
FIG. 1 is a block diagram showing a control circuit according to a first preferred embodiment of the present invention.
Figure 2A:
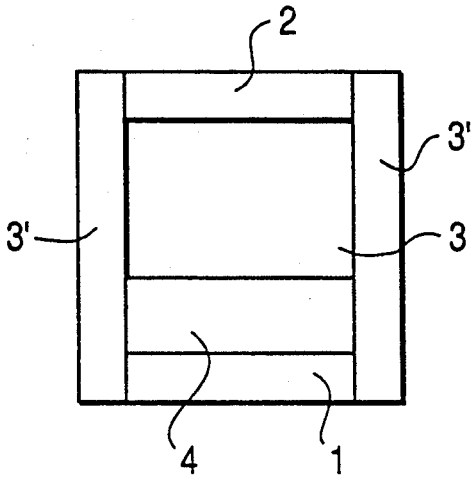
FIGS. 2*a–d* is a schematic view showing a characteristic quantity of refuse obtained through image processing.
Figure 2B:
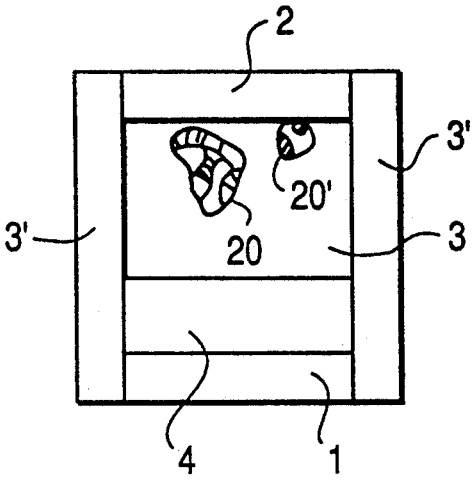
Figure 2C:
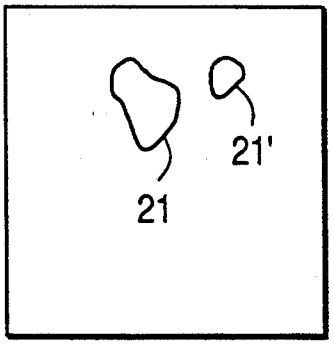
Figure 2D:
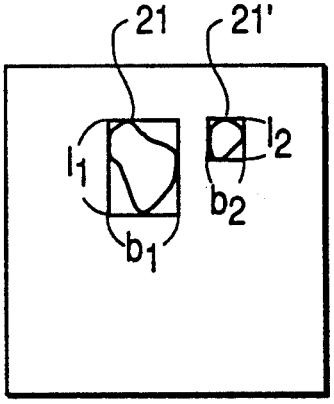
Figure 16:
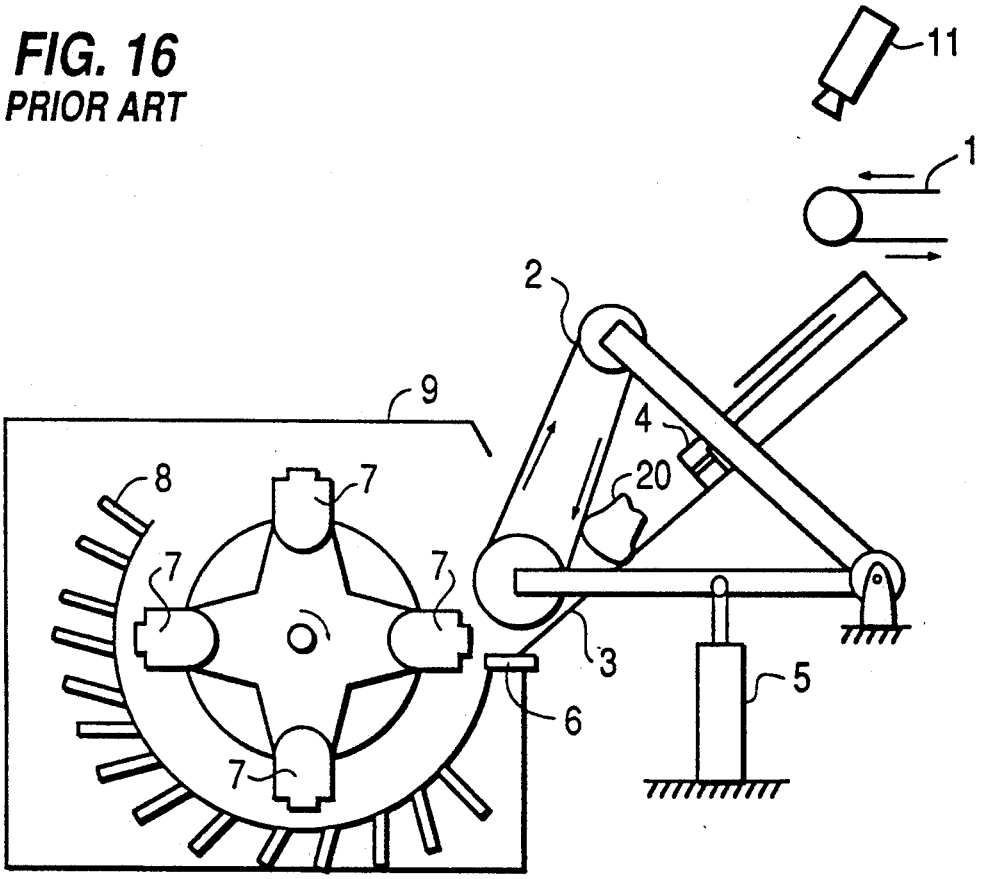
FIG. 16 PRIOR ART
FIG. 16 is a schematic view showing a shredder in the prior art.

FIG. 1 shows a construction of a control circuit, and with respect to a construction of a shredder itself, since it is basically similar to that shown in FIG. 16, like reference numerals are given to the corresponding component parts, and further explanation thereof will be omitted.

In FIG. 1, reference numeral 10 designates a control panel for prestoring various threshold values, numeral 31 designates a control calculator section, numeral 32 designates an image processing section, numeral 33 designates a compression feeder motor (C.F. motor) control section, numeral 34 designates a compression feeder (C.F.) drive motor, numeral 35 designates an elevator cylinder control section, numeral 37 designates a conveyor motor control section, numeral 38 designates a conveyor drive motor, and numeral 39 designates a push-in control section.

In addition, reference numeral 41 designates a current detector for detecting a drive current $i_c$ of the C.F. drive motor 34, numeral 43 designates a shredder motor for carrying out rotary drive of hammers 7 forming principal elements of the shredder, and numeral 42 designates a current detector for detecting a drive current $i_s$ of this shredder motor 43.

An image signal generated by picking up an image of a refuse throw-in section (inlet of a shredding section) 3 with the aid of an ITV camera 11, is transmitted to the image processing section 32. The image processing section 32 performs processing such as binary-coding or the like of the image signal transmitted from the ITV camera 11, calculates a characteristic quantity such as an area of refuse 20, a circumscribing rectangle of the refuse 20 or the like, and transmits the results of calculation to the control calculator section 31. Furthermore, to the control calculator section 31 are input a compression feeder drive motor current $i_c$ and a shredder drive motor current $i_s$, respectively, from the current detectors 41 and 42. In the control calculator section 31, control calculations as will be described in detail later are effected on the basis of these inputs, and control signals obtained as a result of calculation are output to the C.F. motor control section 33, the elevator cylinder control section 35, the conveyor motor control section 37 and the push-in control section 39.

In response to these control signals, the C.F. motor control section 33, the elevator cylinder control section 35, the conveyor motor control section 37 and the push-in control section 39 are adapted to control drive of the corresponding ones of the C.F. drive motor 34, the elevator cylinder 5, the conveyor drive motor 38 and the push-in device 4.

In the above-described construction, a description will first be made as to a method for detecting an amount of refuse 20 by means of the image processing section 32.

FIG. 2(*a*) is a schematic illustration of an image obtained by the ITV camera 11 under the condition where refuse 20 is not present at the refuse throw-in section (an inlet of the shredding section). In this figure, reference numerals 3' and 3' designate side walls of the refuse throw-in section 3, and as a matter of course, an image corresponding to refuse 20 is not present.

Subsequent FIG. 2(*b*) is a schematic illustration of an image obtained by the ITV camera 11 under the condition where refuses 20 and 20' are present at the refuse throw-in section 3. The image shown in FIG. 2(*a*) and the image shown in FIG. 2(*b*) are taken into the image processing section 32 and digitized into "a-image" and "b-image" as termed here. Then the calculation of:

b-image − a-image is effected, and if the result is binary-coded with respect to an appropriate threshold value, then binary-coded images 21 and 21' as shown in FIG. 2(*c*) can be obtained. For these binary-coded images 21 and 21', the respective areas $S_1$ and $S_2$ or lengths ($l_1$, $b_1$), ($l_2$, $b_2$) of edges of circumscribing rectangles as shown in FIG. 2(*d*) are obtained using a well-known of image processing procedure.

In this case, a total of the lengths "l" of the edges in the throw-in direction of the shredder of the circumscribing rectangle, the maximum value "$l_M$" ("$l_1$" in FIG. 2(*d*)), a total of the areas $S_T$ ($=S_1+S_2$), or the maximum value of the area serves as a measure for representing an amount of refuses 20, 20'.

Next, a description will be made as to a control method for a stagnated amount of refuse 20 at the refuse throw-in section 3.

As described above, a total area $S_T$ of the binary-coded images 21, 21', or a maximum value $l_M$ of the length of the edge in the throw-in direction of the shredder of the circumscribing rectangle serves as a measure for representing an amount of refuse. Hence, in the case where, for instance, the maximum length $l_M$ is larger than a certain predetermined reference value $L_2$, that is, in the case where "$l_M > L_2$" becomes fulfilled, the feed conveyor 1 is stopped to temporarily interrupt the feed of refuse 20, and as a result, in the case where the maximum length $l_M$ has become smaller than a certain predetermined reference value $L_1$ ($L_1 < L_2$), that is, at the time point when "$l_M < L_1$" has become fulfilled, the operation of the feed conveyor 1 is recommenced to feed the refuse 20 again.

Next, a description will be made as to a control method for preventing idling slip in the compression feeder 2.

Though the compression feeder 2 is designed to feed refuse 20 to the shredding section while crushing it, if idling slip should occur between the refuse 20 and the compression feeder 2, it becomes impossible either to crush the refuse 20 or to feed it to the shredding section. At the time of automation, it becomes necessary to detect the idling slip and to restore the compression feeder from the idling slip condition to a normal biting condition. Therefore, as a detection method for idling slip, the following procedure is employed. Under the condition where the compression feeder 2 is normally biting refuse 20 and crushing it, the current value $i_c$ of the C.F. drive motor 34 for the compression feeder 2 is larger than a predetermined value. Therefore, if the current $i_c$ of the C.F. drive motor 34 for the compression feeder 2 is equal to or smaller than a certain threshold value for a predetermined period of time or more in despite of the fact that refuse 20 is present at the refuse throw-in section 3 and the area or the above-described maximum length $l_M$ of the binary-coded images 21, 21' of the refuse is larger than a judgement reference $l_\epsilon$ for existence or non-existence of refuse ($l_{M2} > l_{M1} > l_\epsilon > 0$, refuse is not present at the time of $l_{M1} < l_\epsilon$), then it can be judged that idling slip is occurring at the compression feeder 2. If the position of a contact point between the compression feeder 2 and the refuse 20 is shifted to a new position, friction between the compression feeder 2 and the refuse 20 becomes large, and the compression feeder can be restored from an idling slip condition to a normal biting condition. To that end, the compression feeder 2 is once raised by means of the elevator cylinder 5. Since the throw-in part floor of the refuse throw-in section 3 is formed in a slide shape, the refuse 20 would move somewhat in the downward direction. Then, if the compression feeder 2 is lowered again by means of the elevator cylinder 5, the compression feeder 2 and the refuse 20 would come into contact with each other at a new contact point, and thus the compression feeder 2 can be restored into a normal biting condition as described above. Hereinafter, the above-described operation will be called a "biting operation".

Next, a description will be made as to a control method for preventing tripping of the shredder motor 43.

In the case where refuse applying a large shredding load such as a refrigerator or a thick steel sheet must be shredded, unless the refuse is shredded by degrees, a shredding load would abruptly become large, and tripping of the shredder motor 43 would occur. In this case, a feed speed of the refuse 20 to the shredder by means of the compression feeder 2 is set at about such value that the shredder motor 43 may not trip as a result of overloading caused by a number of times of shredding. Then the current value $i_s$ of the shredder motor 43 is kept detected, and if the detected current value $i_s$ becomes equal to or larger than a certain threshold value, either the feed speed of the refuse 20 by the compression feeder 2 is decreased or changed to a "fine-intermittent feed" in which fine feed and momentary stoppage are repeated, and after the time point of this change, drive of the feed conveyor 1 is temporarily stopped, and feed of new refuse 20 is held stopped. Then, when the refuse 20 at the throw-in section 3 has been perfectly eliminated, again the feed conveyor 1 and the compression feeder 2 are operated at a normal velocity and feed of the refuse 20 is recommenced. By taking such procedure, it can be prevented that similar low-velocity feed is effected both in the case of shredding refuse 20 which applies a small shredding load and in the case of shredding refuse 20 which applies a large shredding load, and hence, shredding can be executed efficiently depending upon a shredding load of refuse 20.

In the following, a description will be made as to the operations at the time of practically executing the various kinds of control methods as described above, with reference to FIG. 3.

Figure 3A:
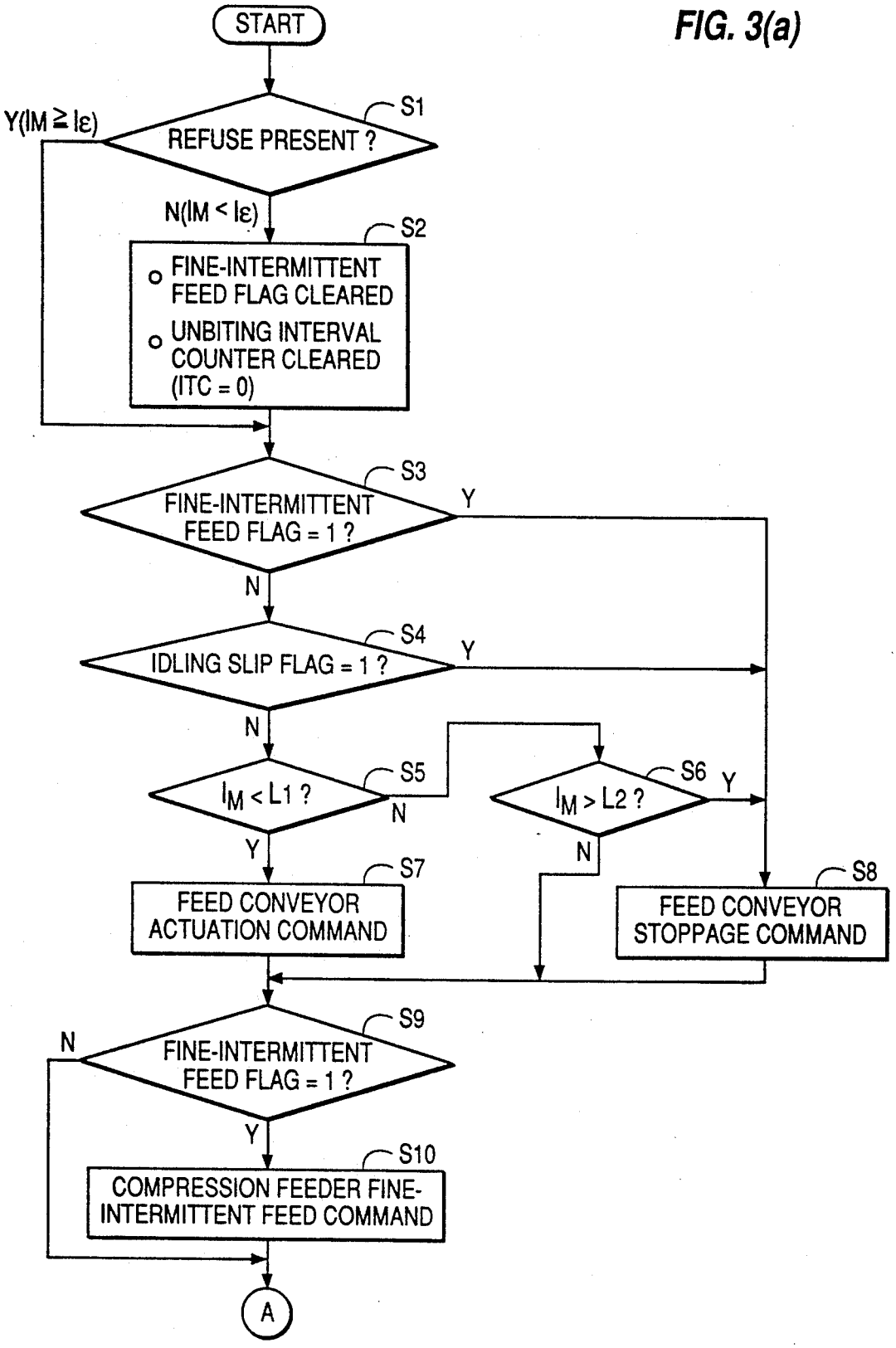
FIGS. 3*a–c* is a flow chart showing contents of operation processing by a control calculator section.
Figure 3B:
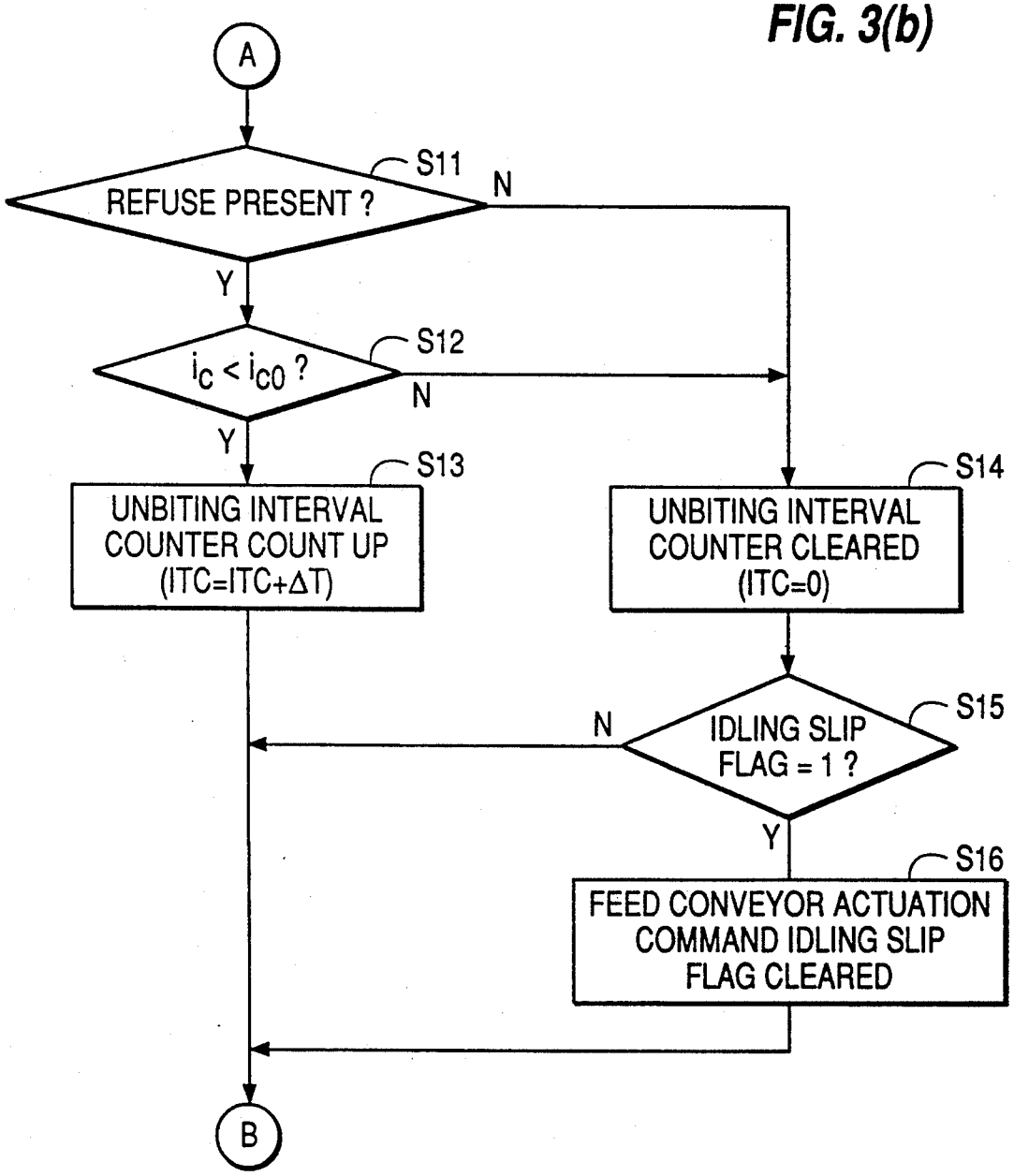
Figure 3C:
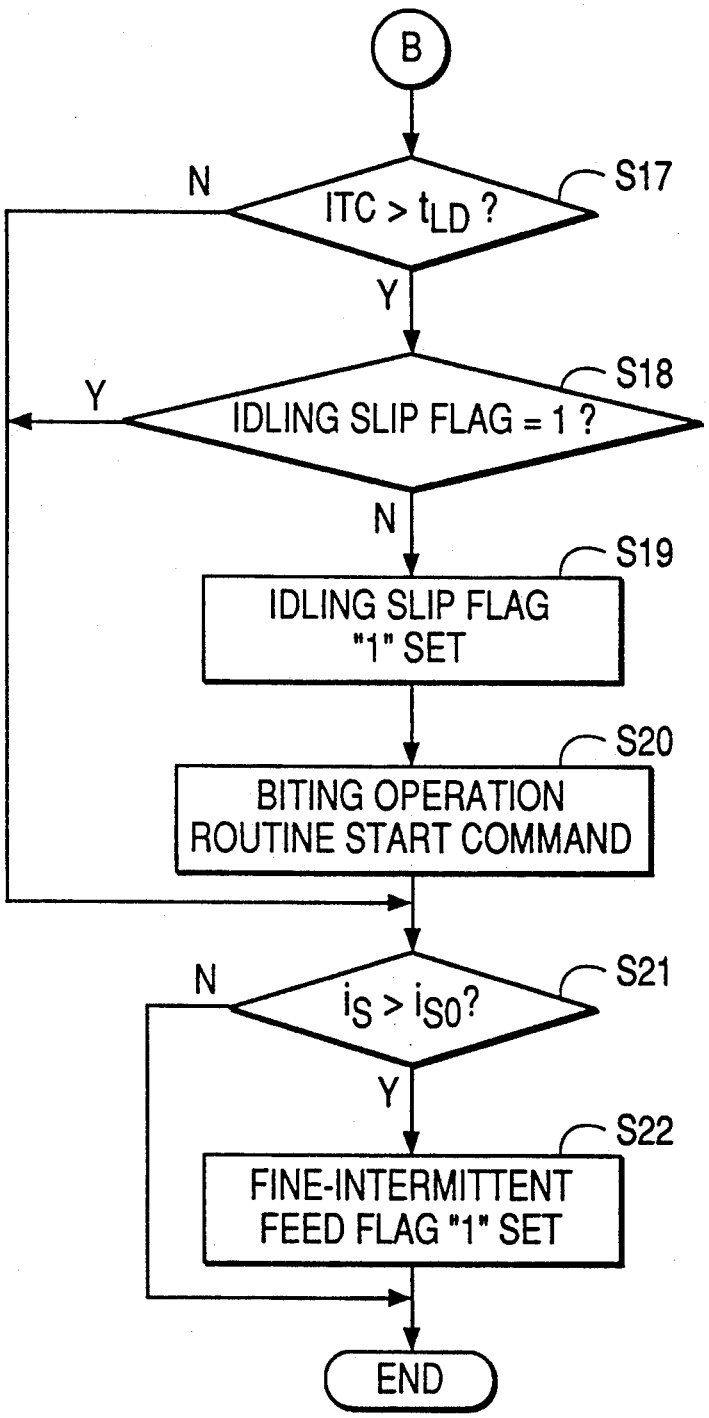

FIG. 3 shows a processing started at predetermined minute time intervals ΔT and repeatedly executed mainly by the control calculator section 31.

In the beginning of the processing, at first, whether refuse 20 is present or not at the refuse throw-in section (the inlet of the shredding section) 3 by a predetermined amount or more, is judged on the basis of a binary-coded image transmitted from the image processing section 32 (Step S1). This is judged by a comparison operation between a threshold value $l_\epsilon$ prestored by an initialization program not shown here and a maximum value $l_M$ of the length of the edge in the throw-in direction of the shredder of the circumscribing rectangle obtained from a binary-coded image transmitted from the image processing section 32, and in the event that a predetermined amount of refuse is not present, a flag register for storing whether fine-intermittent feed is to be executed or not and a counter for counting an unbiting interval provided within the control calculator section 31 are both cleared (Step S2). Whereas, in the event that refuse is present by a predetermined amount or more, the clearing of the above-described flag register and counter is omitted.

Subsequently, whether flag "1" is set or not in a flag register for storing whether or not fine-intermittent feed is to be executed, or whether flag "1" is set or not in a flag register provided within the control calculator section 31 for storing whether or not an idling slip condition is present, is judged (Steps S3 and S4). In the event that flag "1" is set in either flag register, a stoppage command is transmitted from the control calculator section 31 to the conveyor motor control section 37 in order to temporarily stop the feed of refuse 20 by the feed conveyor 1, and the conveyor drive motor 38 is stopped (Step S8).

Otherwise, in the event that flag "1" is not set in either of the above-mentioned flag registers, whether or not the maximum value $l_M$ in the throw-in direction of the shredder of the above-described circumscribing rectangle is smaller than a threshold value $L_1$ prestored by an initialization program, is judged (Step S5).

If "$l_M < L_1$" is judged, an actuation command is transmitted from the control calculator section 31 to the conveyor motor control section 37 in order to release the feed stoppage of the refuse 20 by feed conveyor 1, and the conveyor drive motor 38 is actuated (Step S7).

In the event that "$l_M < L_1$" is not judged, that is, in the event that "$l_M \geqq L_1$" is judged, subsequently whether or not the maximum value $l_M$ in the throw-in direction of the shredder of the same above-described circumscribing rectangle is larger than a threshold value $L_1$ ($L_1 < L_2$) prestored by the initialization program, is judged (Step S6). If "$l_M > L_2$" is judged, similar to the case where flag "1" was set in the flag register for storing whether or not the above-described fine-intermittent feed is to be executed or in the flag register for storing whether or not an idling slide condition is present, a stoppage command is transmitted from the control calculator section 31 to the conveyor motor control section 37 in order to temporarily stop the feed of the refuse 20 by the feed conveyor 1, and the conveyor drive motor 38 is stopped (Step S8).

In the event that "$l_M > L_2$" is not judged, that is, in the event that "$l_M \leqq L_2$" is judged, neither processing of stoppage nor actuation relating to the above-described feed conveyor 1 is executed, but the feeding condition of the refuse 20 by the feed conveyor 1 at that time point is maintained.

Thereafter, whether or not flag "1" is set in the flag register for storing whether or not the fine-intermittent feed is to be executed again, is judged (Step S9). In the event that flag "1" is set in that flag register, a control command is transmitted from the control calculator section 31 to the C.F. motor control section 33 in order to execute fine-intermittent feed by means of the compression feeder 2, and the C.F. drive motor 34 is rotationally driven in a fine-intermittent feed mode (Step S10).

Subsequently, like the above-described beginning of the processing, whether or not refuse 20 is present in the refuse throw-in section 3 by a predetermined amount or more, is again judged on the basis of a binary-coded image transmitted from the image processing section 32 (Step S11).

In the event that refuse is present by a predetermined amount or more, next it is judged whether or not the drive current value $i_c$ of the C.F. drive motor 34 detected by the current detector 41 is smaller than a threshold value $i_{co}$ prestored by the initialization program (Step S12).

In the event that the drive current value $i_c$ of the C.F. drive motor 34 is equal to or larger than the threshold value $i_{co}$, in the case where it was judged that refuse 20 was not present in the above-described step S11, an unbiting interval counter (not shown) provided within the control calculator section 31 is cleared (Step S14) because the possibility of idling slip would be not present, and thereafter it is judged whether or not flag "1" is set in the flag register for storing whether or not an idling slip condition is present (Step S15). In the event that flag "1" is set, subsequently an actuation command is transmitted from the control calculator section 31 to the conveyor motor control section 37 in order to release the stoppage of feed of the refuse 20 by the feed conveyor 1, hence the conveyor drive motor 38 is actuated, and this flag register for storing whether or not an idling slip condition is present, is now cleared (Step S16). This actuation command and the processing of clearing the flag register, are omitted in the case where it has been judged that flag "1" is not set in the flag register for storing whether or not an idling slip condition is present.

Whereas in the event that in the above-described step S12 the drive current value $i_c$ was judged to be smaller than the threshold value $i_{co}$ prestored by the initialization program, next a count value "ITC" of the unbiting interval counter is counted up by a number corresponding to a start period time interval ΔT of this processing (Step S13).

Thereafter, an idling slip condition is judged according to whether or not the count value "ITC" of the unbiting interval counter is larger than a threshold value $t_{LD}$ prestored by the initialization program (Step S17).

If "ITC > $t_{LD}$" is judged, as it means that idling slip is being generated, subsequently it is judged whether or not flag "1" is set in the flag register for storing whether or not an idling slip condition is present (Step S18). If flag "1" is not set, the flag "1" is newly set (Step S19), subsequently a start command of a biting operation of the compression feeder 2 by means of the elevator cylinder 5 is transmitted to the elevator cylinder control section 35, and the elevator cylinder 5 is made to start (Step S20). In the event that flag "1" is set in the flag register for storing whether or not an idling slip condition is present, since it means that a biting operation of the compression feeder 2 by means of the elevator cylinder 5 has been already started, the processing of the steps S19 and S20 is omitted and the biting operation is continued.

After execution of the biting operation has been instructed, if necessary, as described above, the control calculator section 31 judges whether or not the drive current value $i_s$ of the shredder motor 43 is larger than a threshold value $i_{s0}$ prestored by the initialization program, on the basis of a detection signal transmitted from the current detector 42 (Step S21). In the event that the drive current value $i_s$ has been judged to be larger than the threshold value $i_{s0}$, flag "1" is set in the flag register for storing whether or not fine-intermittent feed is to be executed, which is provided within the control calculator section 31 for the purpose of preventing tripping of the shredder motor 43 (Step S22), thus the fine-intermittent feed is prepared, and this processing is then finished. Whereas, in the event that the drive current value $i_s$ has been judged to be equal to or smaller than the threshold value $i_{s0}$, since the possibility of tripping of the shredder motor 43 is not present, the trip preventing processing in the step S22 is omitted and the processing is finished.

Now a second preferred embodiment of the present invention will be explained with reference to FIGS. 4 to 7.

Figure 4:
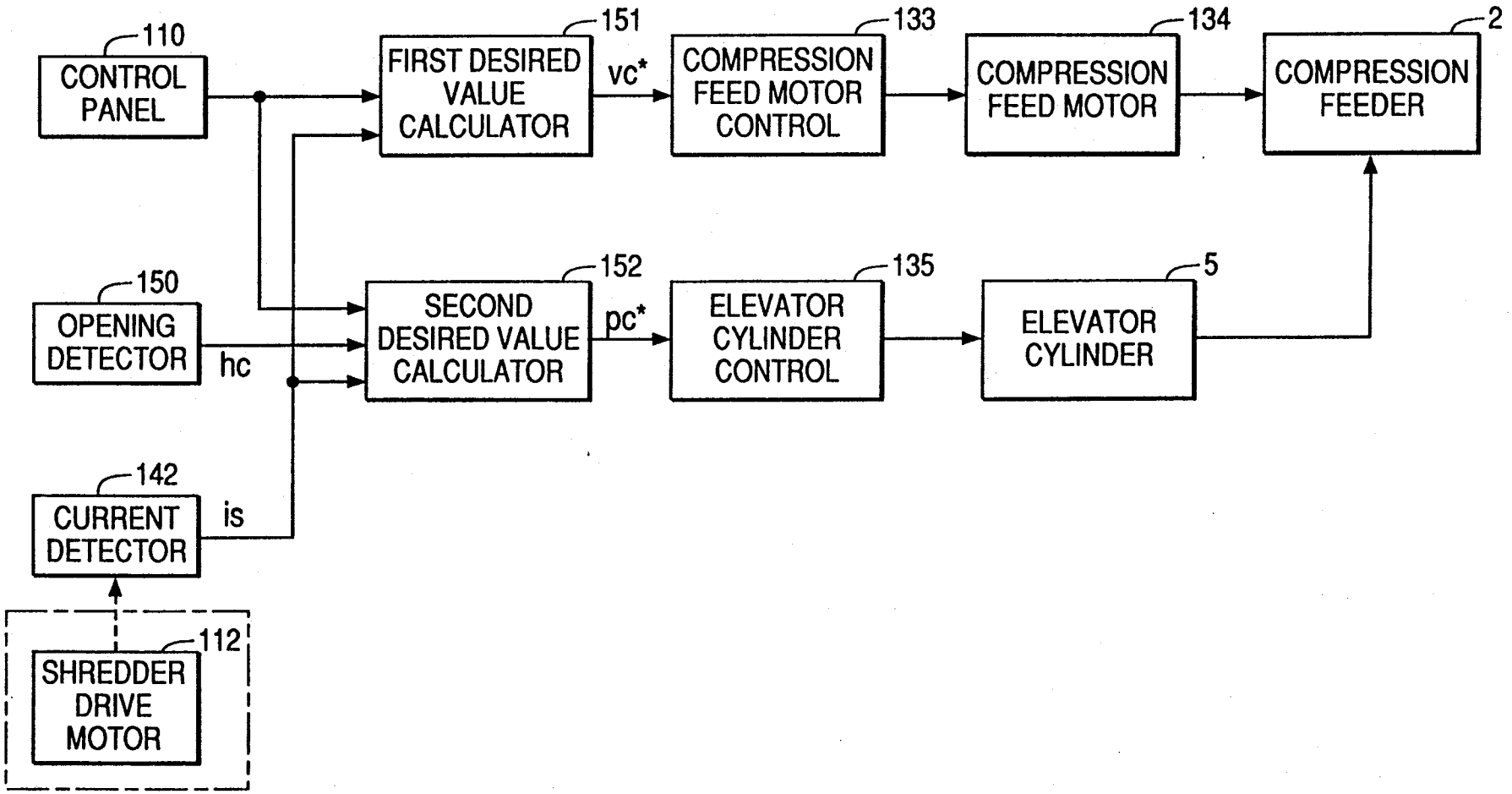
FIG. 4 is a block diagram showing a control circuit according to a second preferred embodiment of the present invention.

FIG. 4 shows a construction of a control system according to a second preferred embodiment of the present invention, but since the construction of the shredder itself is basically identical to that shown in FIG. 16 and described above, the same component parts are given like reference numerals and further explanation thereof will be omitted.

In FIG. 4, reference numeral 142 designates a current detector which detects a drive current $i_s$ of a shredder drive motor 112. Reference numeral 150 designates an opening detector, which detects an opening $h_c$ between the compression feeder 2 and the refuse throw-in section floor at the inlet portion of the shredder main body. Reference numeral 151 designates a first desired value calculator section, which responds to a signal transmitted from a control panel 110 for calculating a desired peripheral velocity $v_c$* and outputs it to a compression feeder (C.F.) motor control section 133. The C.F. motor control section 33 controls driving of the compression feeder (C.F.) drive motor 134 in such a manner that an actual peripheral velocity $v_c$ of the compression feeder 2 may become the desired peripheral velocity $v_c$* calculated in the first desired value calculator section 151.

In addition, reference numeral 152 designates a second desired value calculator section, which responds to a signal transmitted from the control panel 110 for calculating a desired value $p_c$* of a depressing pressure $p_c$ of the elevator cylinder 5 on the basis of the above-described shredder drive motor current $i_s$ and the compression feeder opening $h_c$, and outputs it to an elevator cylinder control section 135. The elevator cylinder control section 135 responds to a signal transmitted from the second desired value calculator section 152 for controlling vertical movement of the elevator cylinder 5 and the depressing pressure $p_c$ of the elevator cylinder.

Figure 5A:
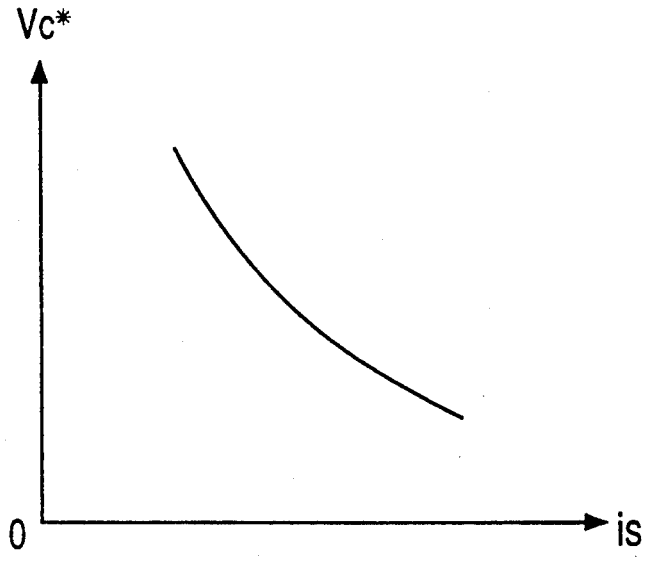
FIGS. 5*a, b* is a diagram showing contents of calculation of a first desired value calculated section shown in FIG. 4.
Figure 5B:
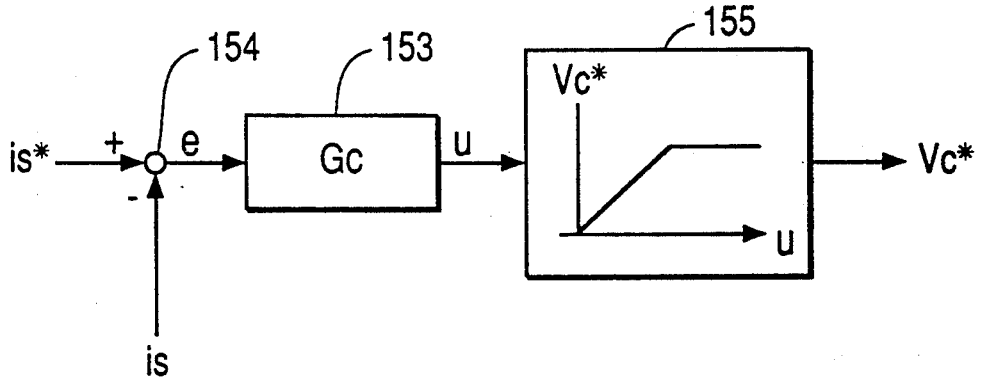

Contents of calculation when the first desired value calculator section 151 calculates the desired peripheral velocity $v_c$* of the compression feeder on the basis of the value of the shredder drive motor current $i_s$ in the above-described construction, are shown in FIG. 5.

FIG. 5(*a*) graphically illustrates a function formula in the case of calculating the desired peripheral velocity $v_c$* as a function of the shredder drive motor current $i_s$, in which the desired peripheral velocity $v_c$* is a decreasing function with respect to the shredder drive motor current $i_s$. As a result of the selection of such a relation, if the shredder drive motor current $i_s$ becomes large, then the desired peripheral velocity $v_c$* would become small accordingly, but on the contrary, if the shredder drive motor current $i_s$ becomes small, then the desired peripheral velocity $v_c$* would become large accordingly. This function formula can be changed by manipulation on the above-described control panel 110.

FIG. 5(*b*) shows a circuit construction in the case where the first desired value calculator section 151 is realized by means of a feedback control circuit in place of the construction illustrated in FIG. 5(*a*) and described above. A difference between a desired value $i_s$* of the shredder drive motor current and an actual shredder drive motor current $i_s$ is calculated by a subtractor 154, and a calculated difference signal e is transmitted to a control calculator 153. In the control calculator 153, control calculation such as a PID operation is effected for the difference signal e to obtain a control calculation signal u, which is output to a saturation element circuit 155. The saturation element circuit 155 calculates a desired peripheral velocity $v_c$* of the compression feeder from the control calculation signal u transmitted from the control calculator 153 according to a function formula shown in this figure, and outputs it to a C.F. motor control section 133 in the next stage.

Figure 6A:
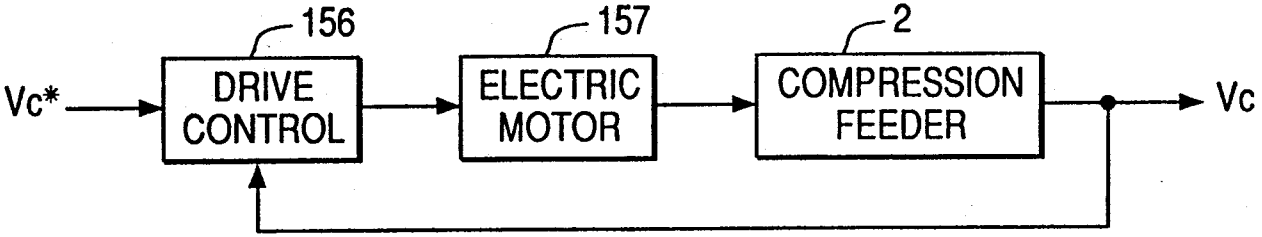
FIGS. 6*a, b* is a block diagram showing constructions of a compression feeder (C.F.) motor control section and a C.F. drive motor.
Figure 6B:
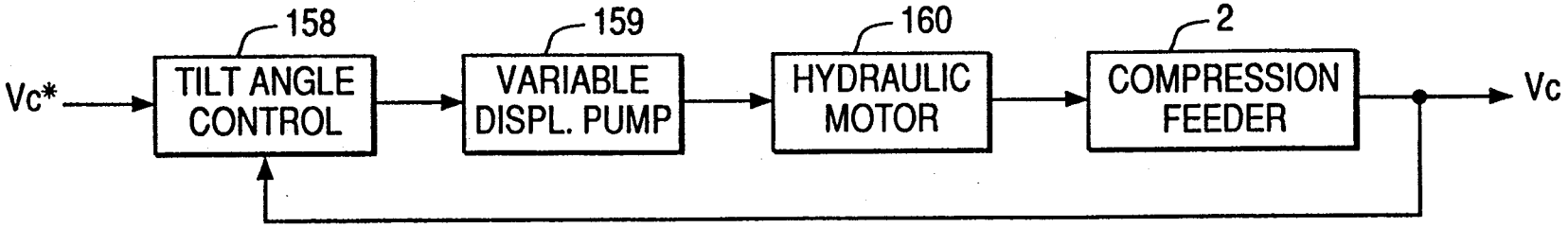

The C.F. motor control section 133 has a different construction depending upon whether the C.F. drive motor 134 is an electric motor or a hydraulic motor. FIG. 6(*a*) shows one example of a practical construction of the C.F. motor control section 133 and the C.F. drive motor 134. In this figure, a desired peripheral velocity $v_c$* of the compression feeder transmitted from the first desired value calculator section 151 is input to a drive control section 156. The drive control section 156 performs feedback-control of an electric motor 157 forming the C.F. drive motor 134 by feeding back the actual peripheral velocity $v_c$ produced by the electric motor 157 on the basis of the above-described desired peripheral velocity $v_c$*.

On the other hand, FIG. 6(*b*) shows one example of a practical construction of the C.F. motor control section 133 and the C.F. drive motor 134. In this figure, a desired peripheral velocity $v_c$* of the compression feeder transmitted from the first desired value calculator section 151 is input to a tilt angle control section 158. The tilt angle control section 158 manipulates a tilt angle of a variable displacement pump 159 rotationally driving an inner volume hydraulic motor 160 forming the C.F. drive motor 134 in such manner that the desired peripheral velocity $v_c$* and an actual peripheral velocity $v_c$ produced by the inner volume hydraulic motor 160 may coincide with each other.

Next, a description will be given as to an inner construction of the second desired value calculator section 152 with reference to FIG. 7. The second desired value calculator section 152 is composed of calculator sections 161 and 162 and a depressing pressure determinator section 163. The calculator section 161 calculates a desired value $p_c1^*$ of a depressing pressure as a function of a shredder drive motor current $i_s$, and transmits it to the depressing pressure determinator section 163. On the other hand, the calculator section 162 calculates a desired value $p_c2^*$ of a depressing pressure as a function of an opening $h_c$ of the compression feeder, and transmits it to the depressing pressure determinator section 163. The depressing pressure determinator section 163 performs calculations according to a particular method for the desired values $p_c1^*$ and $p_c2^*$ transmitted from the calculator sections 161 and 162 to obtain a desired value $p_c^*$ of the depressing pressure, and outputs this to the elevator cylinder control section 135 in the next stage. As a practical procedure of the calculation performed in the depressing pressure determinator section 163, there is known a method such as selecting, for example, a value of a larger one of the desired values $p_c1^*$ and $p_c2^*$, performing an appropriately weighting operation of:

$$m \times p_c1^* + (1-m) \times p_c2^* \quad (1)$$

(where $0<m<1$) for both of the desired values $p_c1^*$ and $p_c2^*$, taking a weighted mean of the desired values $p_c1^*$ and $p_c2^*$, or the like. It is to be noted that the functions of the calculator sections 161 and 162 and parameters of the depressing pressure determinator section 163 are adapted to be changed by manipulation on the control panel 110.

Next, a third preferred embodiment of the present invention will be explained with reference to FIGS. 8 to 10.

Figure 8:
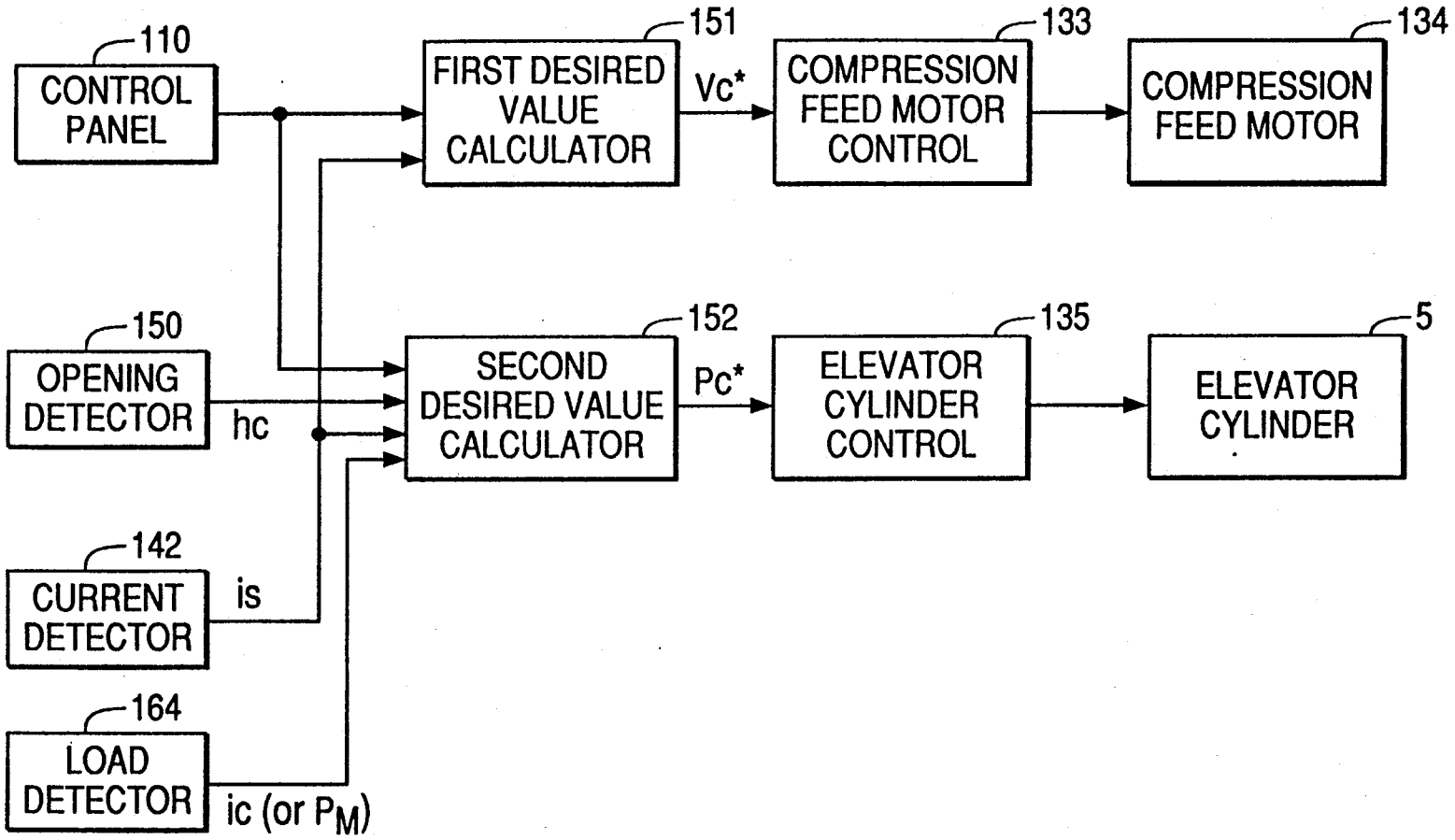
FIG. 8 is a block diagram showing a construction of a control circuit according to a third preferred embodiment of the present invention.

FIG. 8 shows a construction of the control system, and since a basic construction is identical to that shown in FIG. 4 and described above, the same component parts are given like reference numerals and further explanation thereof will be omitted.

In FIG. 8, as compared to FIG. 4 described above, a load detector 164 for detecting a load of a drive motor of the compression feeder 2 is newly added, and in place of the second desired value calculator section 152, a second desired value calculator section 165 is employed.

The load detector 164 is formed of a current detector for detecting a motor current $i_c$ in the case where the drive motor of the compression feeder 2 is an electric motor, but if the drive motor is a hydraulic motor, it is formed of a pressure gauge for detecting a hydraulic pressure $p_M$ at the inlet portion of the hydraulic motor, and the detected motor current $i_c$ (or hydraulic pressure $p_M$) is output to the second desired value calculator section 165.

Figure 9:
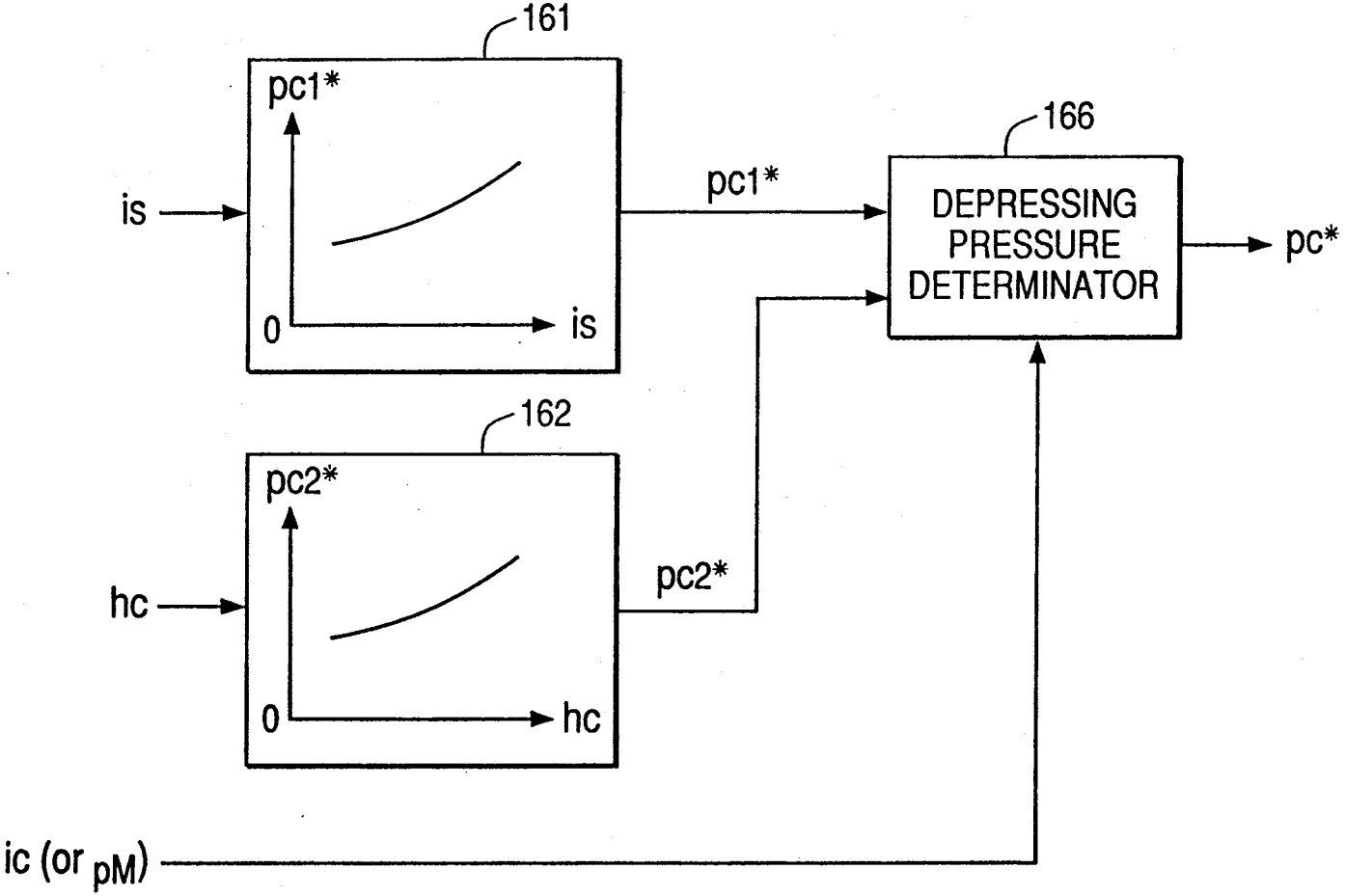
FIG. 9 is a block diagram showing a circuit construction of a second desired value calculator section shown in FIG. 8.

The second desired value calculator section 165 calculates a desired value $p_c^*$ of the depressing pressure of the elevator cylinder 5 on the basis of the shredder drive motor current $i_s$, the opening $h_c$ of the compression feeder and the load signal $i_c$ (or $p_M$) transmitted from the above-described load detector 164 and outputs it to the elevator cylinder control section 135, and an inner construction thereof is shown in FIG. 9.

Figure 7:
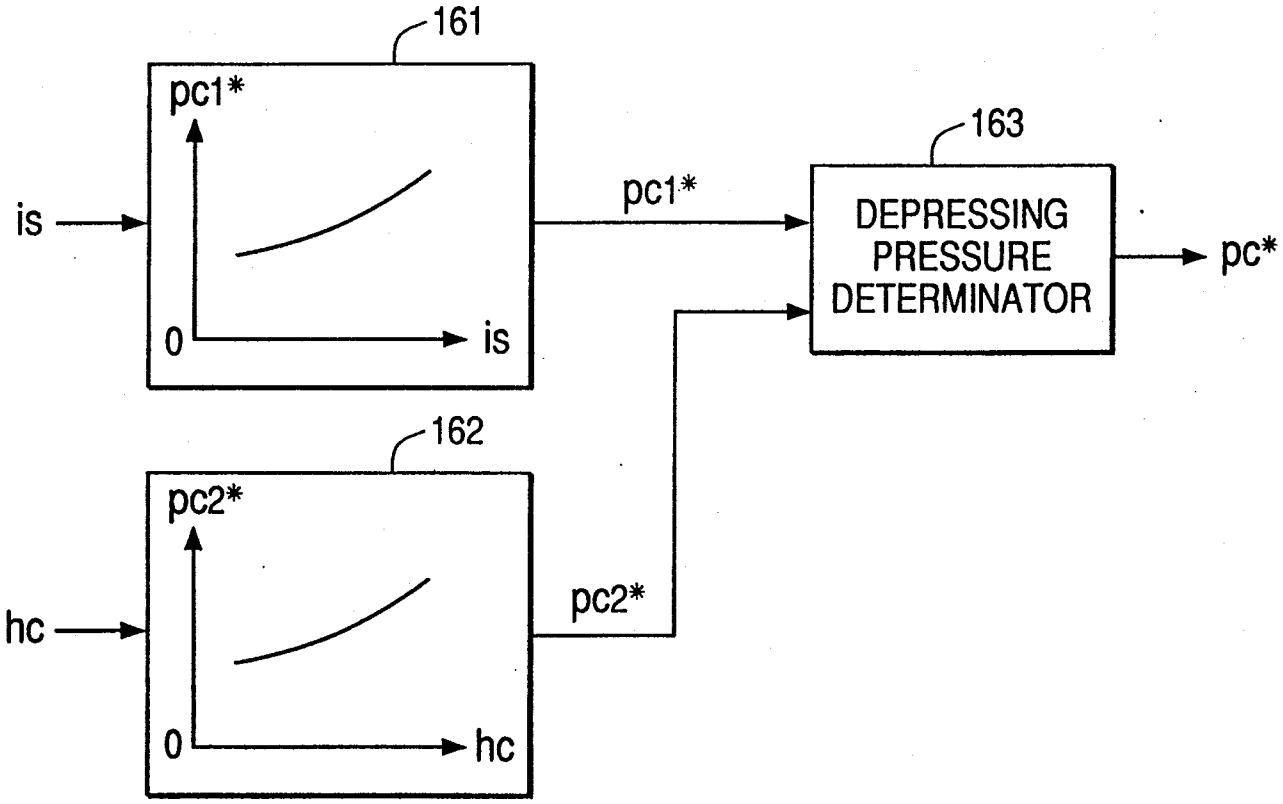
FIG. 7 is a block diagram showing a circuit construction of a second desired value calculator section shown in FIG. 4.

In FIG. 9, as compared to FIG. 7 described above, the construction is such that the depressing pressure determinator section 163 is replaced by a depressing pressure determinator section 166. The depressing pressure determinator section 166 performs calculations according a particular method as described above with reference to FIG. 7 for the desired values $p_c1^*$ and $p_c2^*$ transmitted from the calculator sections 161 and 162 to obtain a possible value ($p_c^*$) of the desired value $p_c^*$ of the depressing pressure, then it gives appropriate attenuation corresponding to the load signal $i_c$ (or $p_M$) transmitted from the above-described load detector 164 to this possible value ($p_c^*$) and it outputs the attenuated value to the elevator cylinder control section 135 as a desired value $p_c^*$. This processing is such that the load signal $i_c$ (or $p_M$) transmitted from the load detector 164 is compared with a preset threshold value, and in the event that it does not exceed the threshold value, ($p_c^*$) is output as $p_c^*$, while only in the event that the load exceeds the threshold value, that is, only in the event that it has been judged that the compression feeder 2 is overloaded, a value obtained by subtracting $n \cdot \Delta p_c$ (n being a number of times of repetition; $\Delta p_c$ being a positive value) from the above-mentioned possible value ($p_c^*$), is output as a desired value $p_c^*$ of the depressing pressure.

Figure 10:
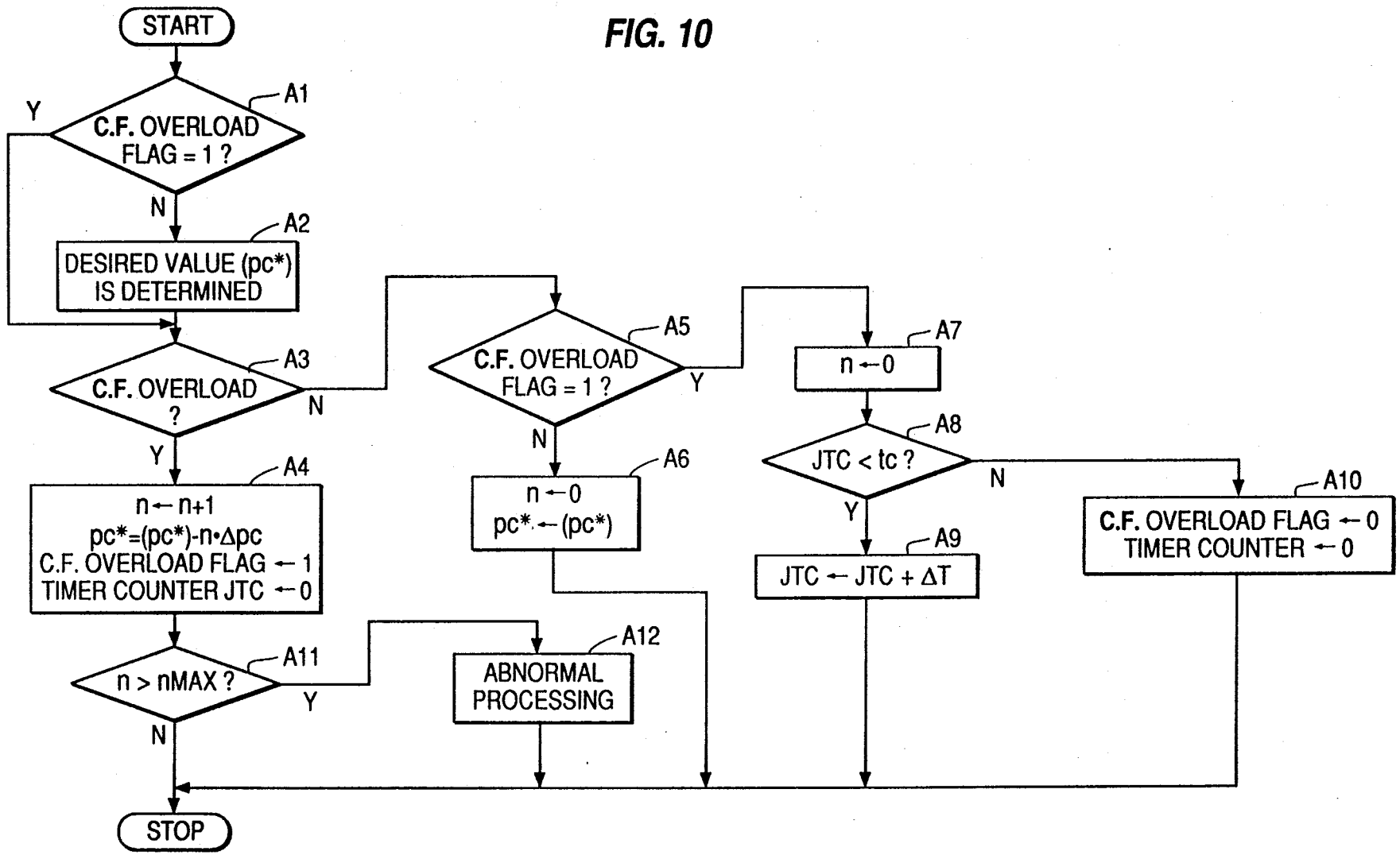
FIG. 10 is a flow chart showing a method for determining a depressing pressure desired value of a compression feeder by means of the second desired value calculator section shown in FIG. 8.

The above-described method for determining the desired value $p_c^*$ is such that the processing is started by software at an interval of a particular minute period of time $\Delta T$ to determine, and its detailed contents are shown in FIG. 10. With reference to FIG. 10, in the beginning of the start, at first it is judged whether flag "1" stands or not in a compression feeder (C.F.) overload flag register provided within the depressing pressure determinator section 166 (Step A1). Only in the case where flag "1" does not stand, a possible value ($p_c^*$) of the desired value $p_c^*$ of the depressing pressure is determined from the desired values $p_c1^*$ and $p_c2^*$ transmitted from the calculator sections 161 and 162 (Step A2).

Thereafter, it is judged whether or not the C.F. drive motor 134 is actually under an overloaded condition (Step A3). If it is not overloaded, again it is judged whether flag "1" stands or not in the C.F. overload flag register (Step A5). Here, if it is judged that flag "1" does not stand, then as it is concluded that the C.F. drive motor 134 is normally operating, the contents of an n-counter for counting a number of times of repetition provided within the depressing pressure determinator section 166 are cleared to "0", also the possible value ($p_c^*$) of the desired value of the depressing pressure obtained in the above-described step A2 is determined as a desired value $p_c^*$, and it is output to the elevator cylinder control section 135 in the next stage (Step A6).

In the case where it has been judged in the above-mentioned step A3 that the C.F. drive motor is under an overloaded condition, after the contents of the n-counter for counting a number of times of repetition have been reset by adding "+1", a calculation of:

$$(p_c^*) - n \cdot \Delta p_c \quad (2)$$

for the reset number of times of repetition n, the above-mentioned possible value ($p_c^*$) of the desired value of the aforementioned depressing pressure and a preset positive value $\Delta p_c$, is carried out, and the result of calculation is output to the elevator cylinder control section 135 in the next stage as the desired value $p_c^*$. At the same time, flag "1" is set in the above-described C.F. overload flag register, and the contents of a timer counter JTC provided within the depressing pressure determinator section 166 are cleared to "0" (Step A4). Thereafter, it is judged whether or not the contents of the n-counter have exceeded its maximum value "$n_{max}$" (Step A11), and in the event that it has been judged to have exceeded, it is judged that the C.F. drive motor 34 is under an abnormal condition, and anomaly processing is effected (Step A12).

In the above-mentioned step A5, if it is judged that flag "1" stands in the C.F. overload flag register, the contents of the n-counter for counting the number of times of repetition n are cleared to "0" (Step A7), and thereafter it is judged whether or not the contents of the timer counter JTC is smaller than a preset overload condition release standby time $t_c$ (Step A8). In the event that it has been judged that the contents of the timer counter JTC are smaller than the overload condition release standby time $t_c$, then it is considered that only a little time has elapsed after the C.F. drive motor 134 was released from an overload condition and hence there is a fear that it may again become an overload condition, and so the contents of the timer counter JTC are added with $\Delta T$ which is a start period time of this program (Step A9). This processing is once finished at this step.

Otherwise, in the step A8, in the case where the contents of the timer counter JTC have become equal to or larger than the preset overload condition release standby time $t_c$, then since it is considered that a predetermined time $t_c$ has elapsed after the C.F. drive motor 134 was released from an overload condition, flag "1" in the C.F. overload flag register is released to "0", also the contents of the timer counter JTC are cleared to "0" (Step A10), and here this processing is once finished.

As described above, in the case where the C.F. drive motor 134 is overloaded, the overload condition is released by lowering the depressing pressure acted by the elevator cylinder 5, and even after the release, until a predetermined period of time $t_c$ has elapsed, the desired value $p_c$* of the depressing pressure is held unchanged.

Next, a fourth preferred embodiment of the present invention will be explained with reference to FIGS. 11 to 15.

Figure 11:
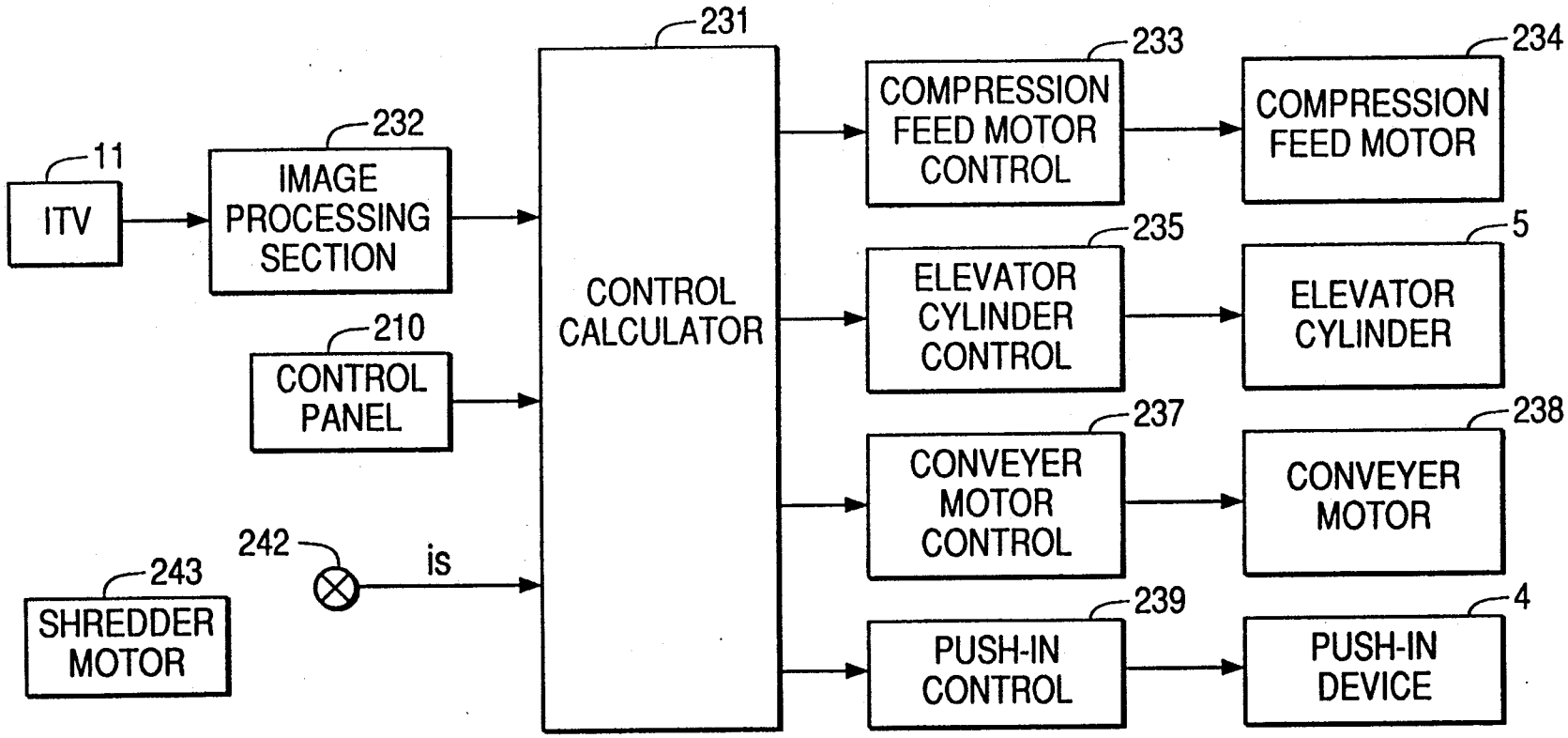
FIG. 11 is a block diagram showing a construction of a control circuit according to a fourth preferred embodiment of the present invention.
Figure 12A:
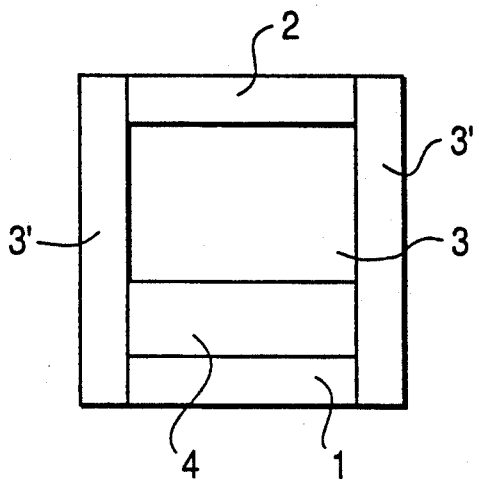
FIGS. 12*a–d* is a schematic view showing a characteristic quantity of refuse obtained by the image processing section shown in FIG. 11.
Figure 12B:
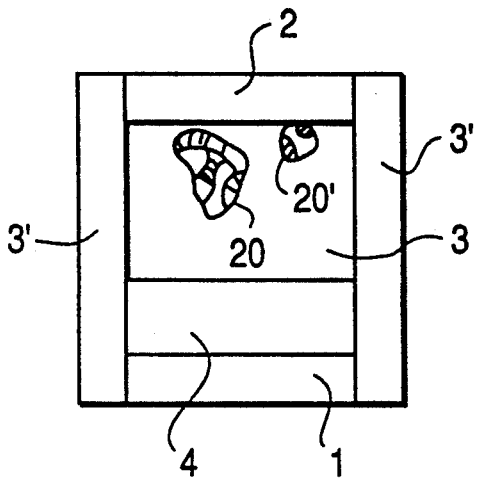
Figure 12C:
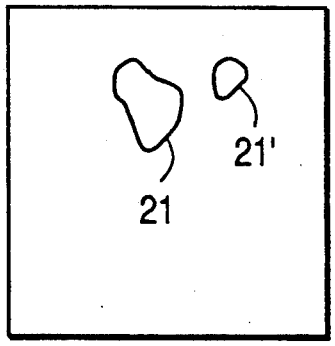
Figure 12D:
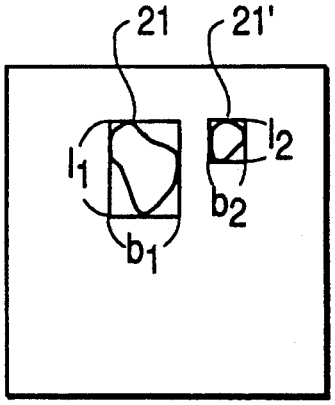

FIG. 11 shows the construction of the control system, but since the construction of the shredder itself is basically similar to that shown in FIG. 16 and described above, identical component parts are given like reference numerals, and further explanation thereof will be omitted.

In FIG. 11, reference numeral 210 designates a control panel for prestoring various threshold valves, numeral 231 designates a control calculator section, numeral 232 designates an image processing section, numeral 233 designates a compression feeder motor (C.F. motor) control section, numeral 234 designates a compression feeder (C.F.) drive motor, numeral 235 designates an elevator cylinder control section, numeral 237 designates a conveyor motor control section, numeral 238 designates a conveyor drive motor, and numeral 239 designates a push-in control section.

In addition, reference numeral 243 designates a shredder motor for effecting rotary drive of hammers 7 which form principal constituent elements of a shredder, and numeral 242 designates a current detector for detecting a drive current $i_s$ of a shredder motor 243.

An image signal obtained by picking out a refuse throw-in section (an inlet of a shredding section) 3 by means of an ITV camera 11, is transmitted to the image processing section 232. The image processing section 232 performs processing such as binary-coding or the like for the image signal transmitted from the ITV camera 11 to calculate a characteristic quantity such as an area of refuse 20 or a circumscribing rectangle or the like of refuse 20 in that image, and transmits the results of calculation to the control calculator section 231. Furthermore, to the control calculator section 231 is input a shredder drive motor current $i_s$ from the current detector 242. The control calculator section 231 performs control calculation, which will be described later in detail, on the basis of these inputs, and outputs control signals obtained as a result of calculation to the C.F. motor control section 233, the elevator cylinder control section 235, the conveyor motor control section 237 and the push-in control section 239.

In response to these control signals, the C.F. control section 233, the elevator cylinder control section 235, the conveyor motor control section 237 and the push-in control section 239 would controllably drive the corresponding C.F. drive motor 234, elevator cylinder 5, conveyor drive motor 238 and push-in device 4, respectively.

In the above-described construction, at first the method for detecting an amount of refuse 20 by the image processing system 232, will be explained.

FIG. 12(*a*) is a schematic illustration of an image obtained by the ITV camera 11 under the condition where refuse 20 is not present at the refuse throw-in section (an inlet of the shredding section). In this figure, reference numerals 3', 3' designate side walls of the refuse throw-in section 3, and as a matter of course, an image corresponding to refuse 20 is not present.

Subsequent FIG. 12(*b*) is a schematic illustration of an image obtained by the ITV camera 11 under the condition where refuses 20 and 20' are present at the refuse throw-in section 3. The image shown in FIG. 12(*a*) and the image shown in FIG. 12(*b*) are taken into the image processing section 232 and digitized into "a-image" and "b-image" as termed here. Then the calculation of "b-image−a-image" is effected, and if the result is binary-coded with respect to an appropriate threshold value, then binary-coded images 21 and 21' as shown in FIG. 12(*c*) can be obtained. For these binary-coded images 21 and 21', the respective areas $S_1$ and $S_2$ or lengths ($l_1$, $b_1$), ($l_2$, $b_2$) of edges of circumscribing rectangle as shown in FIG. 12(*d*) are determined using a well-known image processing procedure.

In this case, a total of the length l of the edges in the throw-in direction of the shredder of the circumscribing rectangle, the maximum value "$l_M$" ("$l_1$" in FIG. 12(*d*)), a total of the areas $S_T(=S_1+S_2)$, or the maximum value of the area serves as a measure for representing an amount of refuses 20, 20'.

Next, a description will be given as to a control method for a stagnated amount of refuse 20 at the refuse throw-in section 3.

As described above, a total area $S_T$ of the binary-coded images 21, 21', or a maximum value $l_M$ of the length of the edge in the throw-in direction of the shredder of the circumscribing rectangle serves as a measure for representing an amount of refuse. Hence, in the case where, for instance, the maximum length $l_M$ is larger than a certain predetermined reference value $L_2$, that is, in the case where "$l_M > L_2$" becomes fulfilled, the feed conveyor 1 is stopped to temporarily interrupt the feed of refuse 20, and as a result, in the case where the maximum length $l_M$ has become smaller than a certain predetermined reference value $L_1$ ($L_1 < L_2$), that is, at the time point when "$l_M < L_1$" has become fulfilled, the operation of the feed conveyor 1 is recommenced to feed the refuse again.

Next, a description will be given as to a control method for preventing idling slip in the compression feeder 2.

Though the compression feeder 2 is designed to feed refuse 20 to the shredding section while crushing it, if idling slip should occur between the refuse 20 and the compression feeder 2, it becomes impossible either to crush the refuse 20 or to feed it to the shredding section. At the time of automation, it becomes necessary to detect the idling slip and to restore the compression feeder from the idling slip condition to a normal biting condition. Therefore, as a detection method for idling slip, the following procedure is employed. That is, under the condition where the compression feeder 2 is normally biting refuse 20 and feeding it to the shredding section 9 while crushing it, as the shredding section 9 shreds the refuse 20, the current $i_s$ of the shredder motor 243 becomes larger than a no load current $i_{s0}$. Accordingly, if "$i_s \leqq i_{s0}$" is fulfilled for a predetermined period of time or more despite of the fact that refuse 20 is present at the refuse throw-in section 3, it would be judged that the refuse 20 is not being fed to the shredding section 9 due to idling slip. Therefore, detection of idling slip is effected in the following manner:

In the case where:

(1) refuse 20 is present at the throw-in section 3, and the area or the above-described maximum length $l_M$ of the binary-coded images 21 and 21' is equal to or larger than a judgement reference for existence or non-existence of refuse ($l_M \geqq l_\epsilon$); and (2) the current $i_s$ of the shredder motor 243 is equal to or smaller than the no load current $i_{s0}$ for a certain period of time or more;

it is judged that idling slip is occurring at the compression feeder 2. In the event that idling slip has occurred, in order to restore the compression feeder to a normal biting condition, operations as indicated below are carried out appropriately: That is, a series of operations called "biting operation" consisting of the operations of:

(1) pushing out the refuse 20 by means of the push-in device 4;

(2) changing the pressing force of the compression feeder 2; and (3) shifting the position of a contact point between the compression feeder 2 and the refuse 20 by once raising the compression feeder 2 a little by means of the elevator cylinder 5 and thereafter lowering it again, and thereby increasing the friction between the compression feeder 2 and the refuse 20;

are carried out. The operation of changing the pressing force of the compression feeder 2 as pointed out in item (2) above is an operation for changing friction between the compression feeder 2 and the refuse 20. Also, since the floor of the throw-in part of the refuse throw-in section 3 is formed in a slide shape, as a result of the operation (3) above of raising the compression feeder 2 a little, the refuse 20 would move a little in the downward direction, and hence, if the compression feeder 2 is lowered again, the compression feeder 2 can grip the refuse 20 at the position of a new contact point.

Next, a description will be given as to a control method for preventing tripping of the shredder motor 243.

In the case where refuse applying a large shredding load such as a refrigerator or a thick steel sheet must be shredded, unless the refuse is shredded by degrees, a shredding load would abruptly become large, and tripping of the shredder motor 243 would occur. In this case, a feed speed of the refuse 20 to the shredder by means of the compression feeder 2 is set at about such value that the shredder motor 243 may not trip as a result of over-loading caused by a number of times of shredding. Then the current value $i_s$ of the shredder motor 243 is kept detected, and if the detected current value $i_s$ becomes equal to or larger than a certain threshold value, either the feed speed of the refuse 20 by the compression feeder 2 is decreased or changed to "fine-intermittent feed" in which fine feed and momentary stoppage are repeated, and after the time point of this change, drive of the feed conveyor 1 is temporarily stopped, and feed of new refuse 20 is held stopped. Then, when the refuse 20 at the throw-in section has been perfectly eliminated, again the feed conveyor 1 and the compression feeder 2 are operated at a normal velocity and feed of the refuse 20 is recommenced. By taking such procedure, it can be prevented that similar low-velocity feed is effected both in the case of shredding refuse 20 which applies a small shredding load and in the case of shredding refuse 20 which applies a large shredding load, and hence, shredding can be executed efficiently depending upon a shredding load of refuse 20.

In the following, a description will be given as to operations at the time of practically executing the various kinds of control methods as described above, with reference to FIGS. 13 to 15.

Figure 13:
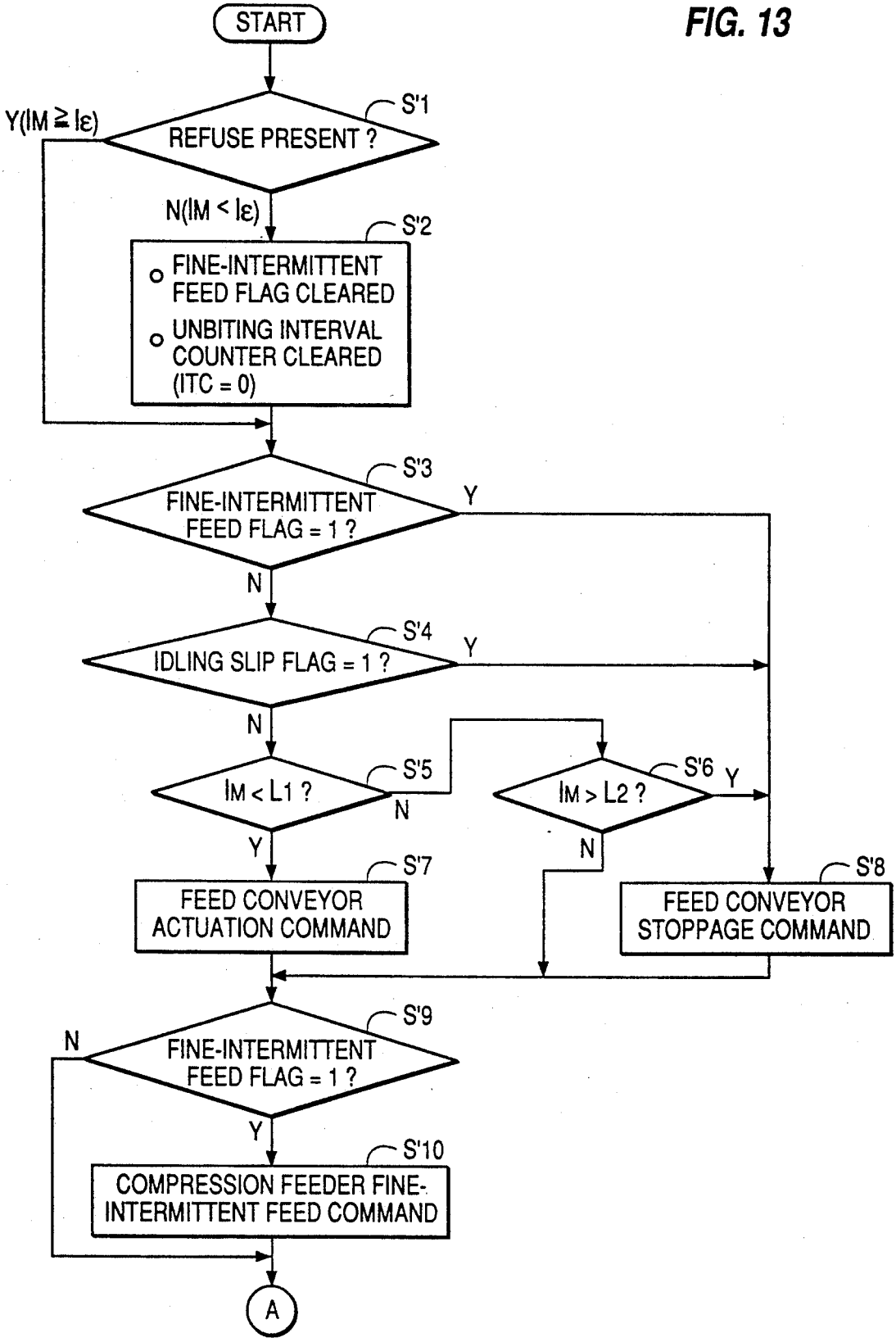
FIG. 13 is a first part of a flow chart showing contents of operation processing by a control calculator section shown in FIG. 11.
Figure 14:
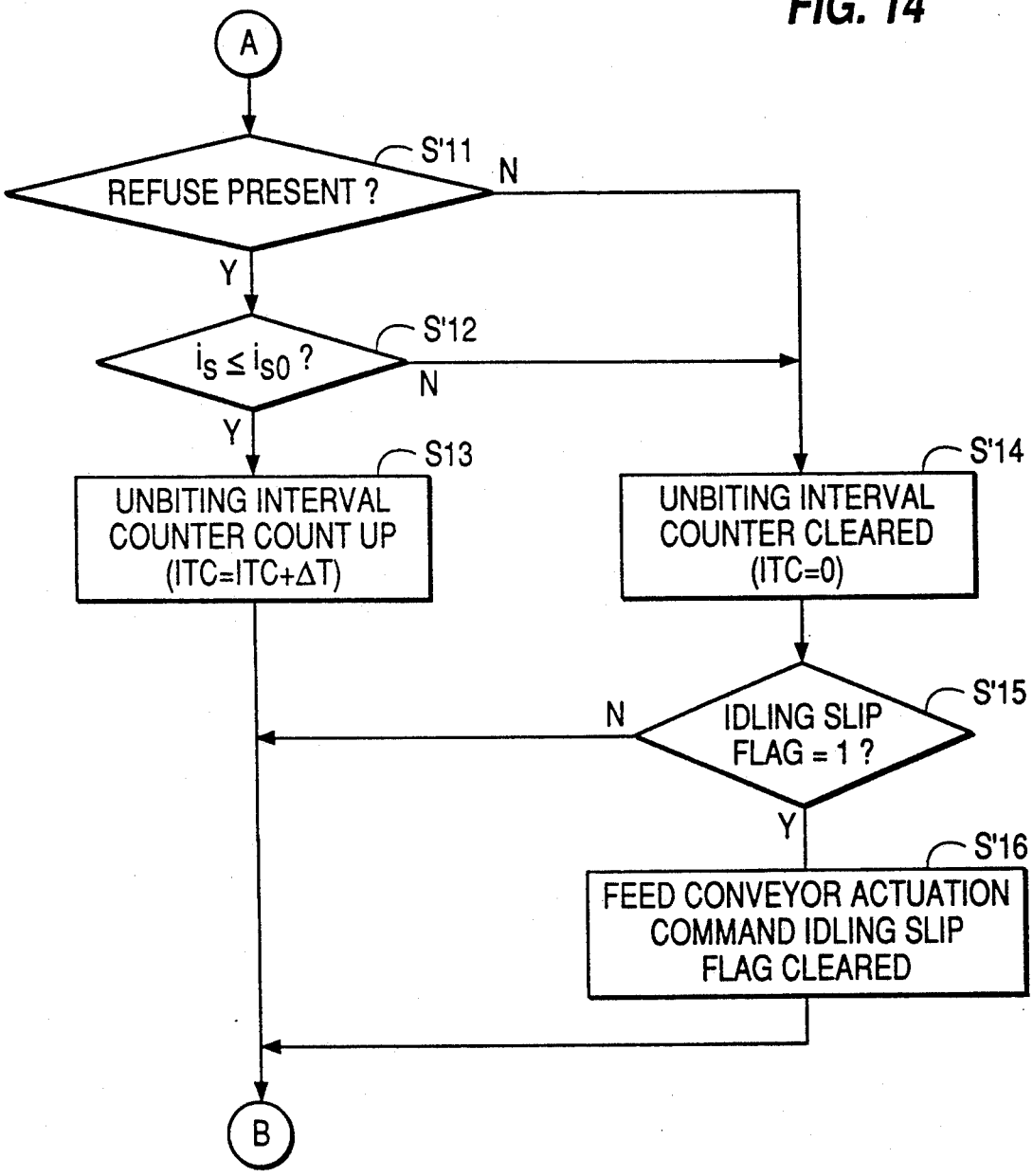
FIG. 14 is a middle part of a flow chart showing contents of operation processing by the control calculator section shown in FIG. 11.
Figure 15:
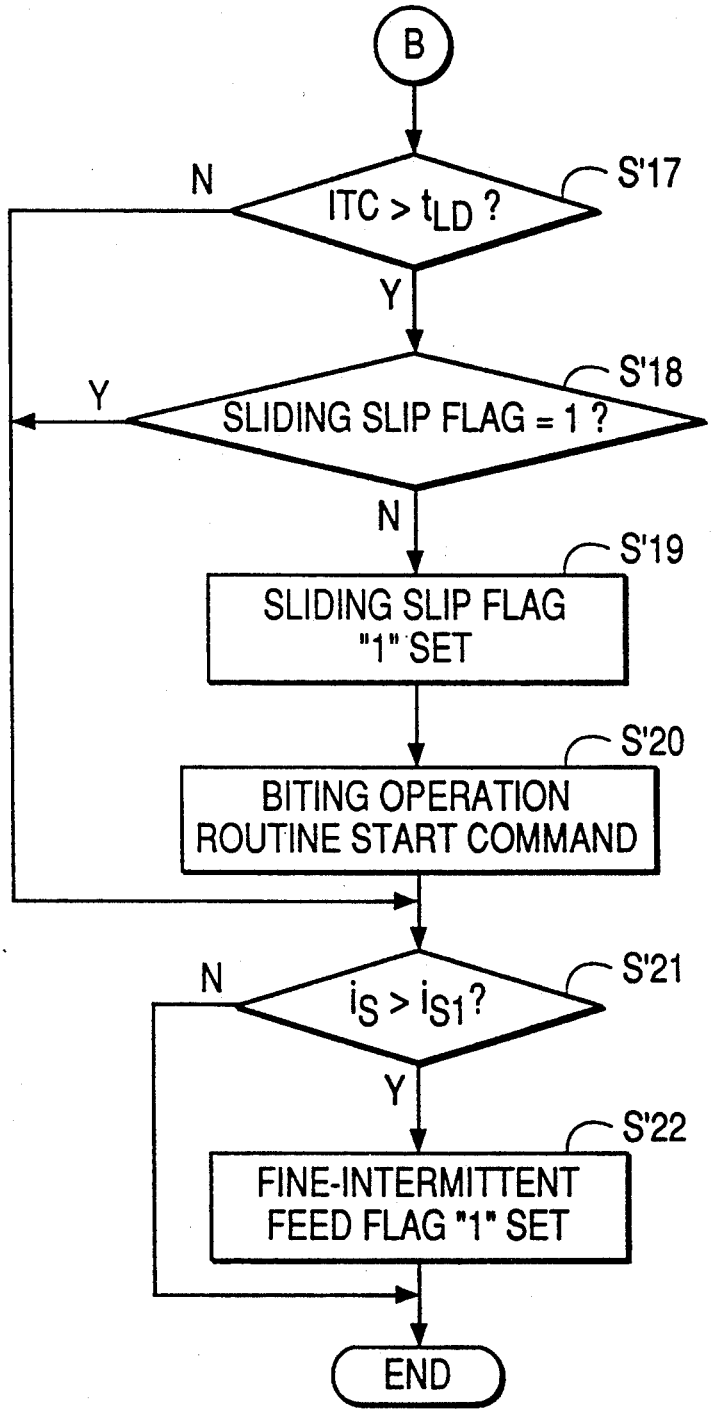
FIG. 15 is a final part of the flow chart showing contents of operation processing by the control calculator section shown in FIG. 11.

FIGS. 13 to 15 show a series of processings started at predetermined minute time intervals $\Delta T$ and repeatedly executed mainly by the control calculator section 231.

In the beginning of the processing, at first, whether refuse 20 is present or not at the refuse throw-in section (the inlet of the shredding section) 3 by a predetermined amount or more, is judged on the basis of a binary-coded image transmitted from the image processing section 232 (Step S'1). This is judged by a comparison operation between a threshold value $l_\epsilon$ prestored by an initialization program not shown here and a maximum value $l_M$ of the length of the edge in the throw-in direction of the shredder of the circumscribing rectangle obtained from a binary-coded image transmitted from the image processing section 232, and in the event that a predetermined amount of refuse is not present, a flag register for storing whether fine-intermittent feed is to be executed or not and a counter for counting an unbiting interval provided within the control calculator section 231 are both cleared (Step S'2). Whereas in the event that refuse is present by a predetermined amount or more, the clearing of the above-described flag register and counter is omitted.

Subsequently, whether flag "1" is set or not in a flag register for storing whether or not fine-intermittent feed is executed, or whether flag "1" is set or not in a flag register provided within the control calculator section 231 for storing whether or not an idling slip condition is present, is judged (Steps S'3 and S'4). In the event that flag "1" is set in either flag register, a stoppage command is transmitted from the control calculator section 231 to the conveyor motor control section 237 in order to temporarily stop the feed of refuse 20 by the feed conveyor 1, and the conveyor drive motor 238 is stopped (Step S'8).

Otherwise, in the event that flag "1" is not set in either of the above-mentioned flag registers, whether or not the maximum value $l_M$ in the throw-in direction of the shredder of the above-described circumscribing rectangle is smaller than a threshold value $L_1$ prestored by an initialization program, is judged (Step S'5).

If "$l_M < L_1$" is judged, an actuation command is transmitted from the control calculator section 231 to the conveyor motor control section 237 in order to release the feed stoppage of the refuse 20 by the feed conveyor 1, and the conveyor drive motor 238 is actuated (Step S'7).

In the event that "$l_M < L_1$" is not judged, that is, in the event that "$l_M \geqq L_1$" is judged, whether or not the maximum value $l_M$ in the throw-in direction of the shredder of the same above-described circumscribing rectangle is larger than a threshold value $L_2$ ($L_1 < L_2$) prestored by the initialization program, is judged (Step S'6). If "$l_M > L_2$" is judged, similar to the case where flag "1" was set in the flag register for storing whether or not the above-described fine-intermittent feed is to be executed or in the flag register for storing whether or not an idling slide condition is present, a stoppage command is transmitted from the control calculator section 231 to the conveyor motor control section 237 in order to temporarily stop the feed of the refuse 20 by the feed conveyor 1, and the conveyor drive motor 238 is stopped (Step S'8).

In the event that "$l_M > L_2$" is not judged, that is, in the event that "$l_M \leqq L_2$" is judged, neither processing of stoppage nor actuation relating to the above-described feed conveyor 1 is executed, but the feeding condition of the refuse 20 by the feed conveyor 1 at that time point is maintained.

Thereafter, whether or not flag "1" is set in the flag register for storing whether or not the fine-intermittent feed is to be executed again, is judged (Step S'9). In the event that flag "1" is set in that flag register, a control command is transmitted from the control calculator section 231 to the C.F. motor control section 233 now in order to execute fine-intermittent feed by means of the compression feeder 2, and the C.F. drive motor 234 is rotationally driven in a fine-intermittent feed mode (Step S'10).

Subsequently, like the above-described beginning of the processing, whether or not refuse 20 is present in the refuse throw-in section 3 by a predetermined amount or more, is again judged on the basis of a binary-coded image transmitted from the image processing section 232 (Step S'11).

In the event that refuse is present by a predetermined amount or more, next it is judged whether or not the drive current value $i_s$ of the shredder drive motor 243 detected by the current detector 242 is equal to or smaller than a threshold value $i_{s0}$ prestored by the initialization program (Step S'12).

In the event that the drive current value $i_s$ of the shredder drive motor 243 is larger than the threshold value $i_{s0}$, and in the event that refuse 20 was judged to be not present in the above-described step S'11, then it is judged that the possibility of idling slip is not present, hence an unbiting interval counter (not shown) provided within the control calculator section 231, is cleared (Step S'14), and thereafter it is judged whether or not flag "1" is set in a flag register for storing whether or not an idling slip condition is present (Step S'15). In the event that flag "1" is set, subsequently an actuation command is transmitted from the control calculator section 231 to the conveyor motor control section 237 in order to release the stoppage of feed of the refuse 20 by the feed conveyor 1, hence the conveyor drive motor 238 is actuated, and this flag register for storing whether or not an idling slip condition is present, is now cleared (Step S'16). This actuation command and the processing of clearing the flag register are omitted in the case where it has been judged that flag "1" is not set in the flag register for storing whether or not an idling slip condition is present.

Whereas in the event that in the above-described step S'12 the drive current value $i_s$ was judged to be equal to or smaller than the threshold value $i_{s0}$ prestored by the initialization program, next a count value "ITC" of the unbiting interval counter is counted up by a number corresponding a start period time interval $\Delta T$ of this processing (Step S'13).

Thereafter, an idling slip condition is judged according to whether or not the count value "ITC" of the unbiting interval counter is larger than a threshold value $t_{LD}$ prestored by the initialization program (Step S'17).

If "$ITC > t_{LD}$" is judged, as it means that idling slip is being generated, subsequently it is judged whether or not flag "1" is set in the flag register for storing whether or not an idling slip condition is present (Step S'18). If flag "1" is not set, the flag "1" is newly set (Step S'19), subsequently a start command of a program for executing the above-described biting operation is issued, and necessary instruments are started by that program (Step S'20). In the event that flag "1" is set in the flag register for storing whether or not an idling slip condition is present, since it means that a biting operation has been already started, the processing of the steps S'19 and S'20 is omitted, and the biting operation is continued.

After execution of the biting operation has been instructed, if necessary, as described above, the control calculator section 231 judges whether or not the drive current value $i_s$ of the shredder motor 243 is larger than a threshold value $i_{s1}$ prestored by the initialization program, on the basis of a detection signal transmitted from the current detector 242 (Step S'21). In the event that the drive current value $i_s$ has been judged to be larger than the threshold value $i_{s1}$, flag "1" is set in the flag register for storing whether or not fine-intermittent feed is to be executed, which is provided within the control calculator section 231 for the purpose of preventing tripping of the shredder motor 243 (Step S'22), thus the fine-intermittent feed is prepared, and this processing is then finished. Whereas, in the event that the drive current $i_s$ has been judged to be equal to or smaller than the threshold value $i_{s1}$, since the possibility of tripping of the shredder motor 243 is not present, the trip preventing processing in the step S'22 is omitted and the processing is finished.

It is to be noted that while a length of an edge of a circumscribing rectangle in an image is employed as a measure for the amount of refuse 20 in FIGS. 13 to 15, as described previously, modification could be made so as to employ an area value of the rectangle.

As described in detail above, according to the present invention, detection of a stagnated state of refuse becomes possible, also feed of a proper amount of refuse which is neither excessive nor short, detection and restore of generation of idling slip, detection of tendency and prevention of tripping of a shredder drive motor, and the like become possible, and so, an operation control system for a shredder which can automate a shredder and can greatly reduce a burden of an operator, can be provided.

In addition, since a feed rate of refuse is controlled so that a shredder drive motor can be operated always nearly at a rating current by performing feedback control for a peripheral velocity of a compression feeder for feeding refuse on the basis of a drive current value of a shredder drive current, and since troubles which may occur at the drive motor for the compression feeder are avoided by performing feedback control for a depressing pressure of an elevator cylinder which regulates an opening of the compression feeder, on the basis of a drive load of the drive motor of the compression feeder, an operation control system for a shredder, which can avoid unnecessary troubles by carrying out feed of refuse efficiently and holding a depressing pressure of the compression feeder alway at a proper value, can be provided.

While a principle of the present invention has been described above in connection to a number of preferred embodiments of the invention, it is intended that all matter contained in the above description and illustrated in the accompanying drawings shall be interpreted to be illustrative and not in a limiting sense.

What is claimed is:

1. An operation control system for a shredder composed of a refuse feeding section and a refuse shredding section, comprising:

image pickup means for picking up an image of a refuse inlet of said shredding section;

image processing means for image-processing an image signal generated by said image pickup means to obtain a characteristic quantity of said refuse; and control calculator means for calculating and outputting a control signal for controlling a feed conveyor and a feeder provided in said refuse feeding section and said refuse shredding section on the basis of said characteristic quantity of the refuse obtained by said image processing means;

wherein said image processing means determines as the characteristic quantity an area of the refuse or length dimensions of a circumscribing rectangle of the refuse using a binary-coded image of the refuse picked up by said image pick up means, and said control calculator means calculates and outputs a control signal for instructing a feed of refuse if the area of the refuse or a length in the throw-in direction of the shredder of the circumscribing rectangle of the refuse is equal to or smaller than a first threshold value, and said control calculator means calculates and outputs a control signal for instructing feed stoppage of the refuse if said area of said length is equal to or larger than a second threshold value which is larger than said first threshold.

2. An operation control system for a shredder composed of a refuse feeding section consisting of a compression feeder and a feed conveyor, and a refuse shredding section for shredding refuse fed from said feeding section, comprising:

image pickup means for picking up an image of a refuse inlet of said refuse shredding section;

image processing means for image-processing an image signal generated by said image pickup means to obtain a characteristic quantity of said refuse;

current detector means for detecting a drive current value of a drive motor of said compression feeder; and control calculator means for calculating and outputting a control signal for controlling a feed rate of refuse at said refuse feeding section on the basis of said characteristic quantity of the refuse obtained by said image processing means and said drive current value of the drive motor detected by said current detector means;

wherein said image processing means determines as the characteristic quantity an area of the refuse or length dimensions of a circumscribing rectangle of the refuse using a binary-coded image of the refuse picked up by said image pick up means, and said control calculator means calculates and outputs a control signal for instructing a biting operation, in which said compression feeder is temporarily moved as a result of a judgement that the compression feeder is idling, if both said drive current value of the drive motor detected by said current detector means is equal to or smaller than a predetermined threshold value for at least a predetermined period of time and the area of the refuse or the length in the throw-away direction of the shredder of the circumscribing rectangle of the refuse determined by said image processing means is not zero.

3. An operation control system for a shredder composed of a refuse feeding section and a refuse shredding section, comprising:

image pickup means for picking up an image of a refuse inlet of said refuse shredding section;

image processing means for image-processing an image signal generated by said image pickup means to obtain a characteristic quantity of said refuse;

current detector means for detecting a drive current value of a drive motor for driving a shredder of said refuse shredding section; and control calculator means for calculating and outputting a control signal for controlling a feed rate of refuse at said feeding section on the basis of said characteristic quantity of the refuse obtained by said image processing means and said drive current value of the drive motor detected by said current detector means;

wherein said image processing means determines as said characteristic quantity an area of the refuse or length dimensions of a circumscribing rectangle of the refuse using a binary-coded image of the refuse picked up by said image pick up means, and said control calculator means calculates and outputs a control signal which suppresses a feed rate of the refuse at said feeding section so as to prevent overloading of the drive motor of said shredder when the drive current value of the drive motor detected by said current detector means has become equal to or larger than a first predetermined threshold value, wherein said control calculator means releases the suppression to the feed rate of the refuse at said feeding section when the area of the refuse or the length in the throw-in direction of the shredder of the circumscribing rectangle of the refuse determined by said image processing means has become equal to or smaller than a second predetermined threshold value.

4. An operation control system for a shredder composed of a refuse feeding section consisting of a compression feeder and a feed conveyor for feeding refuse, and a refuse shredding section for shredding refuse fed from said feeding section, comprising:

image pickup means for picking up an image of a refuse inlet of said shredding section;

image processing means for image-processing an image signal generated by said image pickup means to obtain a characteristic quantity of said refuse;

first current detector means for detecting a drive current value of a drive motor of said compression feeder;

second current detector means for detecting a drive current value of a drive motor of said shredder; and control calculator means for calculating and outputting a control signal for controlling a feed rate of refuse at said feeding section on the basis of said characteristic quantity of the refuse obtained by said image processing means and said drive current values detected respectively by said first current detector means and said second current detector means.

* * * * *